US008001939B2

(12) United States Patent
Hathaway

(10) Patent No.: US 8,001,939 B2
(45) Date of Patent: Aug. 23, 2011

(54) VALVE LASH ADJUSTMENT AND INSPECTION APPARATUS

(75) Inventor: Thomas J. Hathaway, Farmington Hills, MI (US)

(73) Assignee: Cinetic Automation Corporation, Farmington Hills, MI (US)

( * ) Notice: Subject to any disclaimer, the term of this patent is extended or adjusted under 35 U.S.C. 154(b) by 236 days.

(21) Appl. No.: 12/486,801

(22) Filed: Jun. 18, 2009

(65) Prior Publication Data

US 2009/0250031 A1 Oct. 8, 2009

Related U.S. Application Data

(60) Division of application No. 11/511,665, filed on Aug. 29, 2006, now Pat. No. 7,559,301, which is a continuation-in-part of application No. 11/120,099, filed on May 2, 2005, now Pat. No. 7,207,301, which is a continuation of application No. 10/601,994, filed on Jun. 23, 2003, now Pat. No. 6,973,905.

(60) Provisional application No. 60/393,139, filed on Jul. 1, 2002.

(51) Int. Cl.
*F01L 1/18* (2006.01)

(52) U.S. Cl. ..... 123/90.43; 123/90.45; 123/90.59; 74/569

(58) Field of Classification Search ..... 123/90.15, 123/90.43, 90.45, 90.39, 90.17, 90.26, 90.59; 74/53, 55, 569
See application file for complete search history.

(56) References Cited

U.S. PATENT DOCUMENTS

| | | | |
|---|---|---|---|
| 2,731,198 | A | 1/1956 | Hathaway |
| 2,775,886 | A | 1/1957 | Lathrop et al. |
| 2,826,062 | A | 3/1958 | Brown et al. |
| 3,065,636 | A | 11/1962 | Pfann |
| 3,212,324 | A | 10/1965 | Martin |
| 3,477,286 | A | 11/1969 | Baker |
| RE26,782 | E | 2/1970 | Preston |
| 3,558,866 | A | 1/1971 | Poulson |
| 3,717,053 | A | 2/1973 | Sturges |
| 3,939,920 | A | 2/1976 | Hardiman et al. |
| 3,965,778 | A | 6/1976 | Aspers et al. |
| 3,973,434 | A | 8/1976 | Smith |
| 3,974,685 | A | 8/1976 | Walker |

(Continued)

FOREIGN PATENT DOCUMENTS

DE 3002015 A1 7/1980

(Continued)

OTHER PUBLICATIONS

"Adjusting avle Lash", SHOtimes FAQ, http://www.shotimes.com/SHO3valvelash.html (2 pages) May 10, 2002.

(Continued)

*Primary Examiner* — Zelalem Eshete
(74) *Attorney, Agent, or Firm* — Harness, Dickey & Pierce, P.L.C.

(57) ABSTRACT

An apparatus and method for automatically adjusting the valve lash of an internal combustion engine is provided. In another aspect of the present invention, a probe is employed for verifying and/or setting valve lash settings in an automated manner. A further aspect of the present invention does not require determination of a zero lash position or reference datum prior to adjusting the valve lash adjusting screw for desired lash.

15 Claims, 16 Drawing Sheets

U.S. PATENT DOCUMENTS

| | | | | |
|---|---|---|---|---|
| 3,974,883 | A | | 8/1976 | Sigmund |
| 3,977,064 | A | * | 8/1976 | Mote et al. ..... 29/216 |
| 3,988,925 | A | | 11/1976 | Seccombe et al. |
| 4,008,773 | A | | 2/1977 | Wallace et al. |
| 4,163,310 | A | | 8/1979 | Sigmund |
| 4,163,311 | A | | 8/1979 | Sigmund |
| 4,521,863 | A | | 6/1985 | Solaroli |
| 4,697,459 | A | | 10/1987 | Nonomura et al. |
| 5,143,351 | A | | 9/1992 | Pierce |
| 5,226,229 | A | | 7/1993 | Pierce |
| 5,377,112 | A | | 12/1994 | Brown, Jr. et al. |
| 5,445,117 | A | | 8/1995 | Mendler |
| 5,450,772 | A | | 9/1995 | Barone et al. |
| 5,459,940 | A | | 10/1995 | McKenzie |
| 5,591,919 | A | | 1/1997 | Hathaway et al. |
| 6,205,850 | B1 | | 3/2001 | Wehrman et al. |
| 6,415,755 | B1 | | 7/2002 | McCarthy |
| 6,474,283 | B1 | | 11/2002 | Gidlund |
| 6,546,347 | B2 | | 4/2003 | Batchelor et al. |
| 2002/0017257 | A1 | | 2/2002 | Axmacher et al. |
| 2002/0035978 | A1 | | 3/2002 | Usko |
| 2002/0077762 | A1 | | 6/2002 | Batchelor et al. |

FOREIGN PATENT DOCUMENTS

| | | |
|---|---|---|
| GB | 448530 | 6/1936 |

OTHER PUBLICATIONS

Intellect™ System User's Manual, Ingersoll-Rand #99387607, Revision 01—May 1998, cover and pp. (ii)-(ix), all of §1, all of §4 and all of §6.

European Search Report for EP 1 378 741 A1, Sep. 25, 2003, 1 page.

"Signature Analysis System, Technology to Enhance Qualityin Manufacturing" article, www.sciemetric.com (8 pages), believed to be dated before Aug. 29, 2006.

"Signature Analysis, Applying R&D Science to the Manufacturing Plant" article, from Focus publication of Association of British Healthcare Industries (ABHI), pp. 6 and 7, Apr. 2006.

* cited by examiner

VALVE LASH ADJUSTMENT AND INSPECTION APPARATUS

CROSS-REFERENCE TO RELATED APPLICATIONS

This application is a divisional of U.S. application Ser. No. 11/511,665, filed on Aug. 29, 2006, which is a continuation-in-part of U.S. patent application Ser. No. 11/120,099, filed on May 2, 2005, now U.S. Pat. No. 7,207,301, issued Apr. 24, 2007, which is a continuation of U.S. patent application Ser. No. 10/601,994, filed on Jun. 23, 2003, now U.S. Pat. No. 6,973,905, issued Dec. 13, 2005, which application claims the benefit of U.S. Provisional Application No. 60/393,139, filed on Jul. 1, 2002. The disclosures of the above applications are incorporated herein by reference.

BACKGROUND AND SUMMARY OF THE INVENTION

The present invention generally relates to valve lash adjustment apparatuses, and more particularly to an automatic valve lash adjustment machine and method.

Internal combustion engines utilize valves for controlling the introduction of fuel to the cylinders and for exhaustion of product of combustion from the cylinders. The valves are controlled in opening and closing by a cam shaft. For many engines, the cam shaft actuates a valve lifter which in turn actuates the valve usually through a push rod and rocker arm acting on the valve stem. For engines using mechanical or solid valve lifters, "valve lash" is the gap or clearance that exists between the rocker arm and the butt-end of the valve stem. It is important for purposes of valve timing, proper sealing, and engine noise to have a proper amount of clearance in the actuating linkage for engines using mechanical or solid valve lifters. Engines using hydraulic valve lifters require a proper amount of preload in the actuating linkage. With mechanical lifters, too little clearance will result in the improper sealing of the valve itself and will materially contribute to its early failure. Too much clearance will result in improper valve timing and excessive engine noise. Improper preload on hydraulic lifters cause similar problems. In the past it has been the common practice to hand-set each engine valve lash (generally two valves for each cylinder). This method involved the operator using a feeler gage inserted in the actuating mechanism to determine when the operator had properly positioned the screw adjustment. This involved great skill of the operator in determining the feeler gage clearance. If a lock nut is used for securing the adjusting screw, the operation was further complicated by the need for a third hand or some compensation for tightening the lock nut without affecting the lash adjustment. The above-described manual techniques are generally considered overly time-consuming and costly for modern engine assembly techniques, and prone to error.

Automatic valve lash adjusting tools have also been developed. Such an automatic tool is disclosed in U.S. Pat. No. 3,988,925 entitled "Valve Lash Adjusting Tool and Method Therefor," which issued to Seccombe et al. on Nov. 2, 1976. This prior automatic tool, however, still has room for accuracy and adjustment speed improvements. U.S. Patent Publication No. 2002/0077762 entitled "Method and Apparatus for Automatically Setting Rocker Arm Clearances in an Internal Combustion Engine," which was published on Jun. 20, 2002, discloses an automatic adjustment device; however, this device requires the machine to first set a zero position or reference datum prior to adjusting the rocker arm. Furthermore, U.S. Pat. No. 6,474,283 entitled "Valve Lash Setting Method and Device for Executing the Method" which issued to Gidlund on Nov. 5, 2002, discloses an automatic setting machine which does not use a gauge or probe for verifying lash results. All of these patents and patent publications are incorporated by reference herein.

In accordance with the present invention, an apparatus and method for automatically adjusting the valve lash of an internal combustion engine is provided. In another aspect of the present invention, a probe is employed for verifying and/or setting valve lash settings in an automated manner. A further aspect of the present invention does not require positioning of an adjusting screw to a zero lash position or reference datum prior to adjusting the valve lash adjusting screw for desired lash.

The valve lash adjustment apparatus and method of the present invention are advantageous over conventional devices since the speed and accuracy of the valve lash adjustment are enhanced with the present invention. Furthermore, automatic verification and, if need be, resetting can be employed with the present invention. Additional advantages and features of the present invention will become apparent from the following description and appended claims, taken in conjunction with the accompanying drawings.

DETAILED DESCRIPTION OF THE PREFERRED EMBODIMENTS

Figure 1:
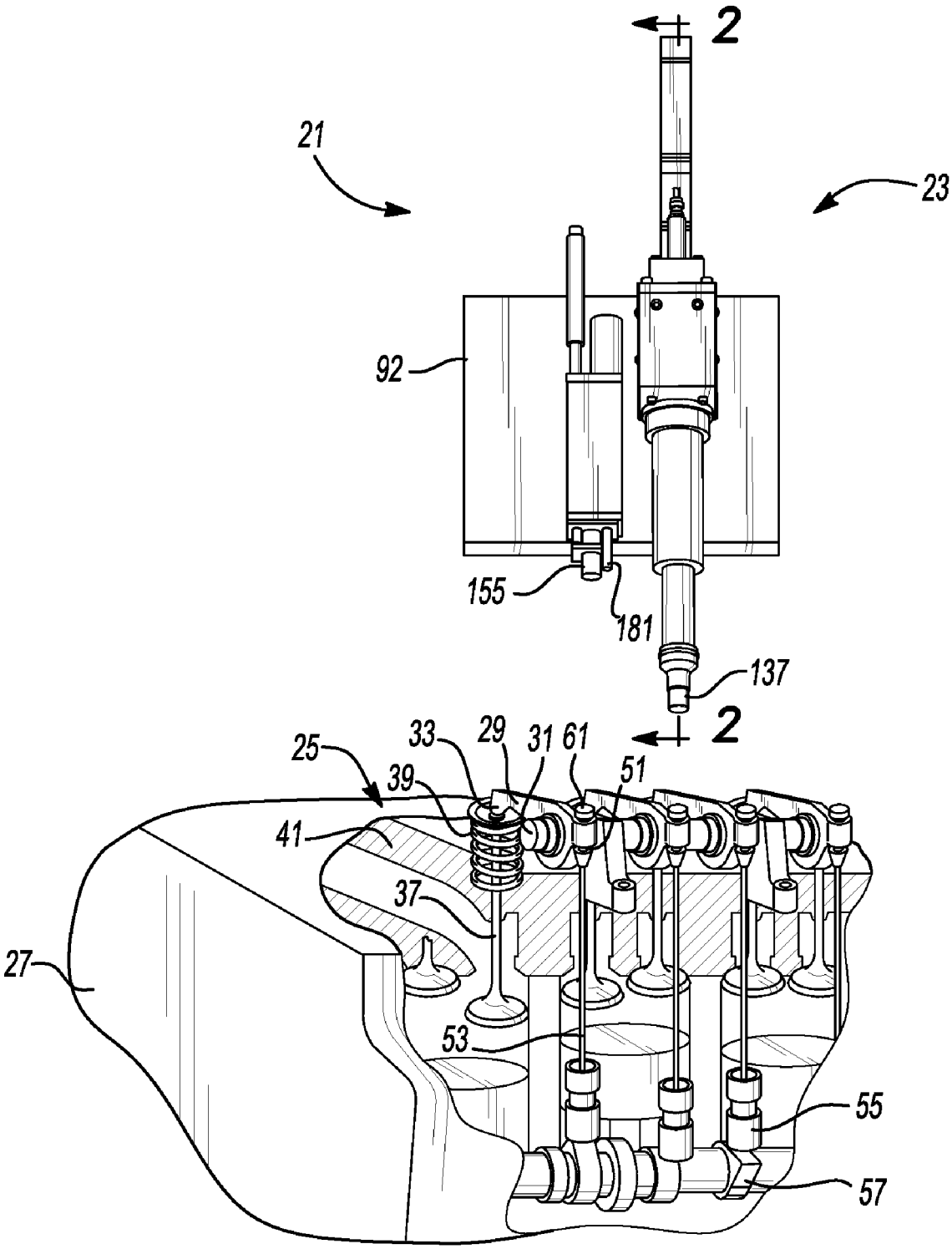
FIG. 1 is a partially fragmented perspective view showing the preferred embodiment of a valve lash adjustment apparatus of the present invention.
Figure 2:
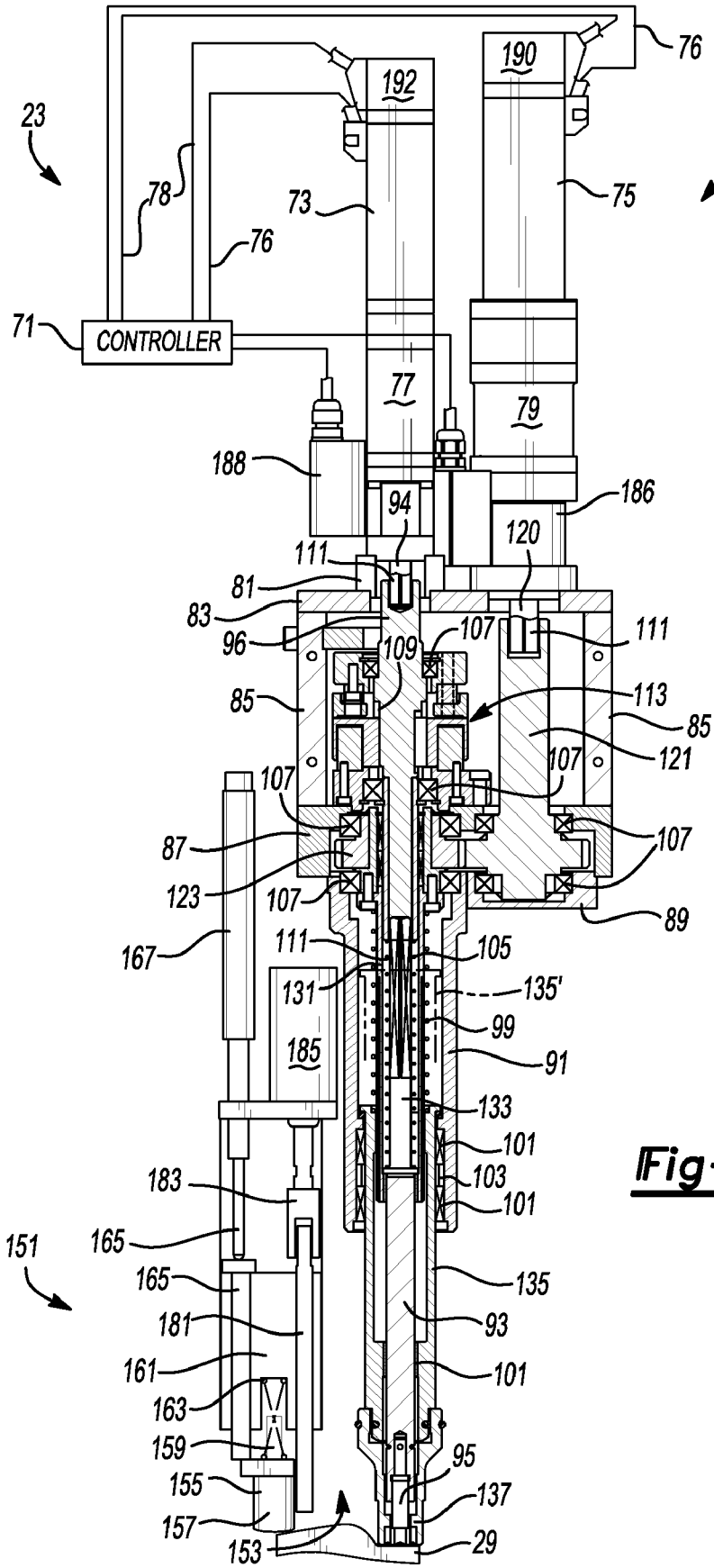
FIG. 2 is a longitudinal cross sectional view, taken along line 2-2 of FIG. 1, showing the preferred embodiment of the valve lash adjustment apparatus.
Figure 3:
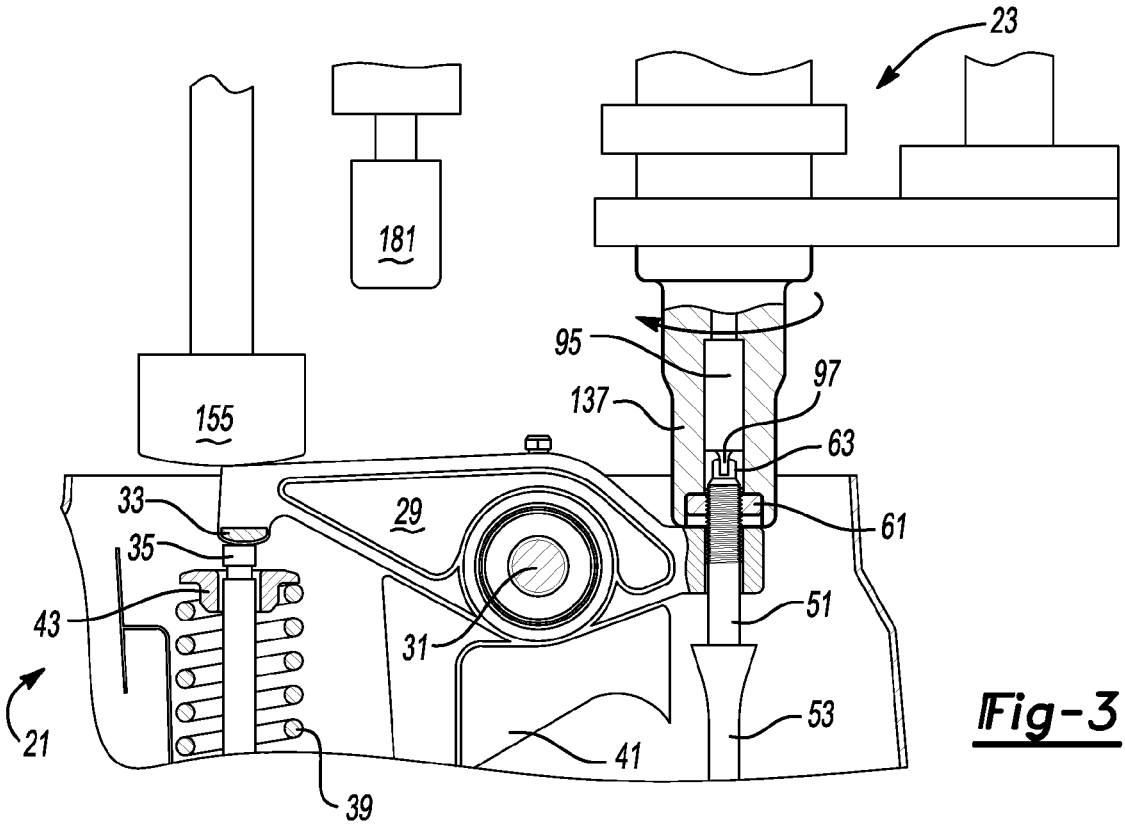
FIGS. 3-12B are partially fragmented and side diagrammatic views showing the preferred embodiments of the valve lash adjustment method of the present invention.
Figure 4:
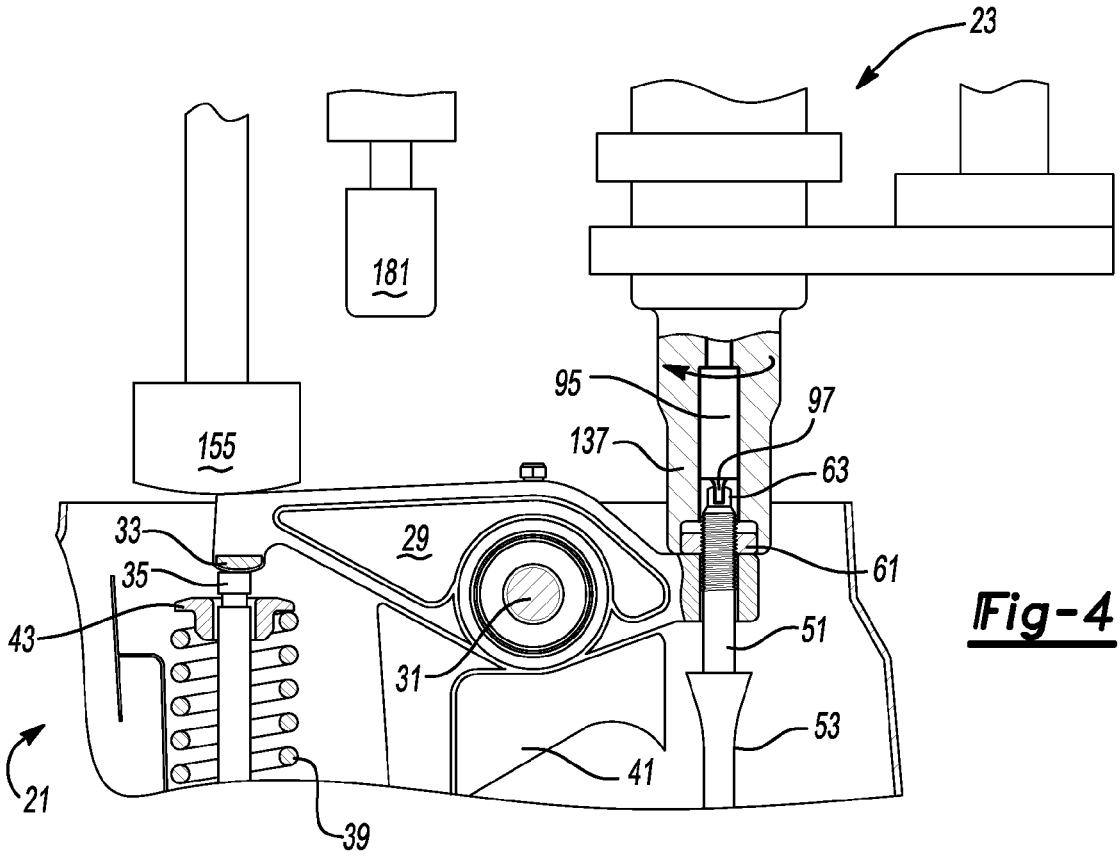
Figure 5:
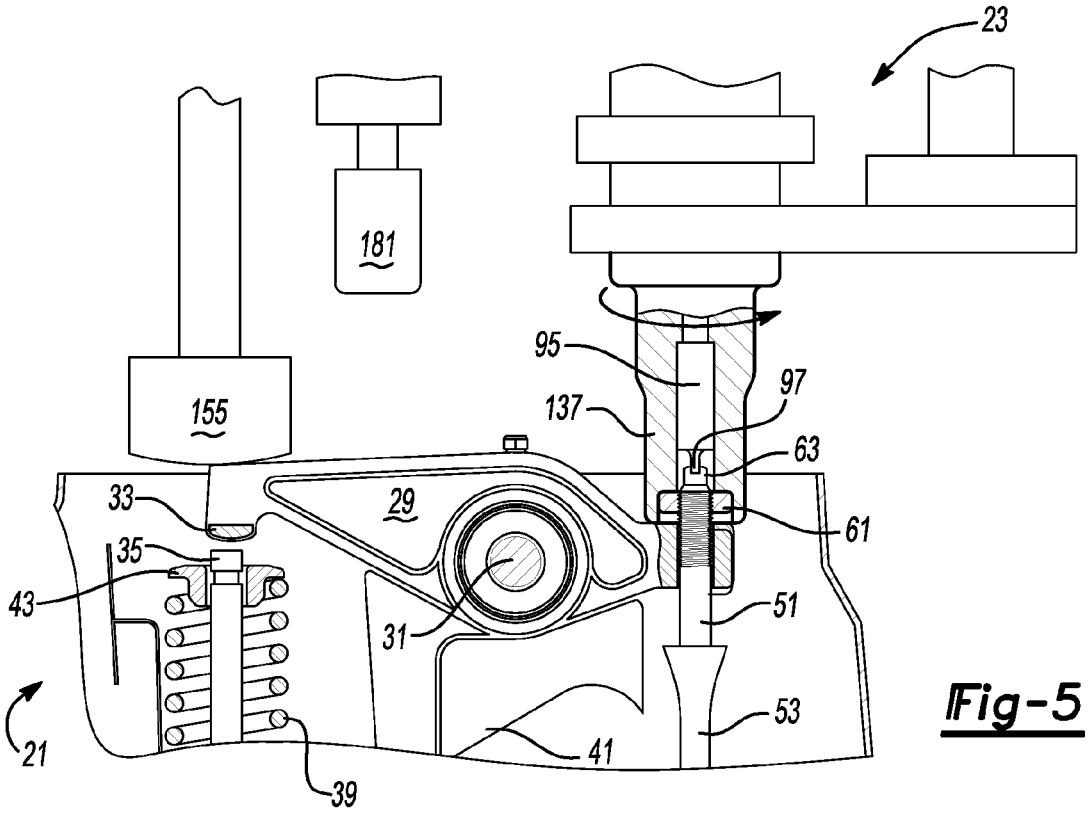
Figure 6:
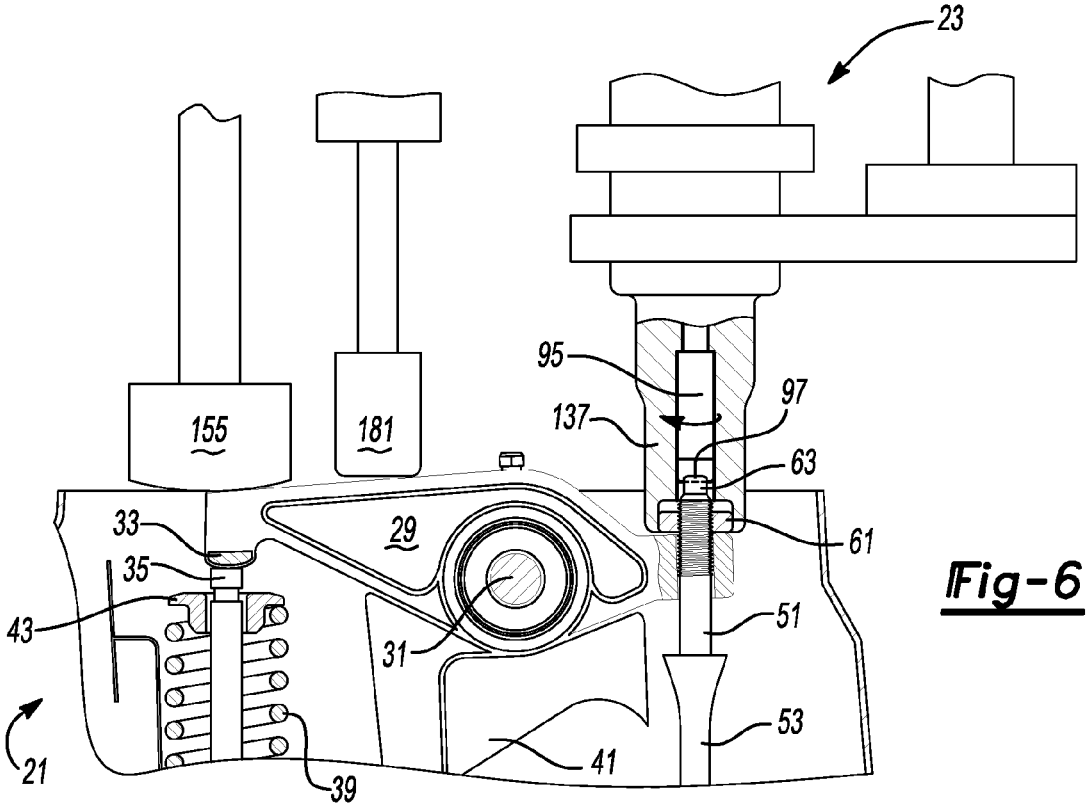
Figure 7:
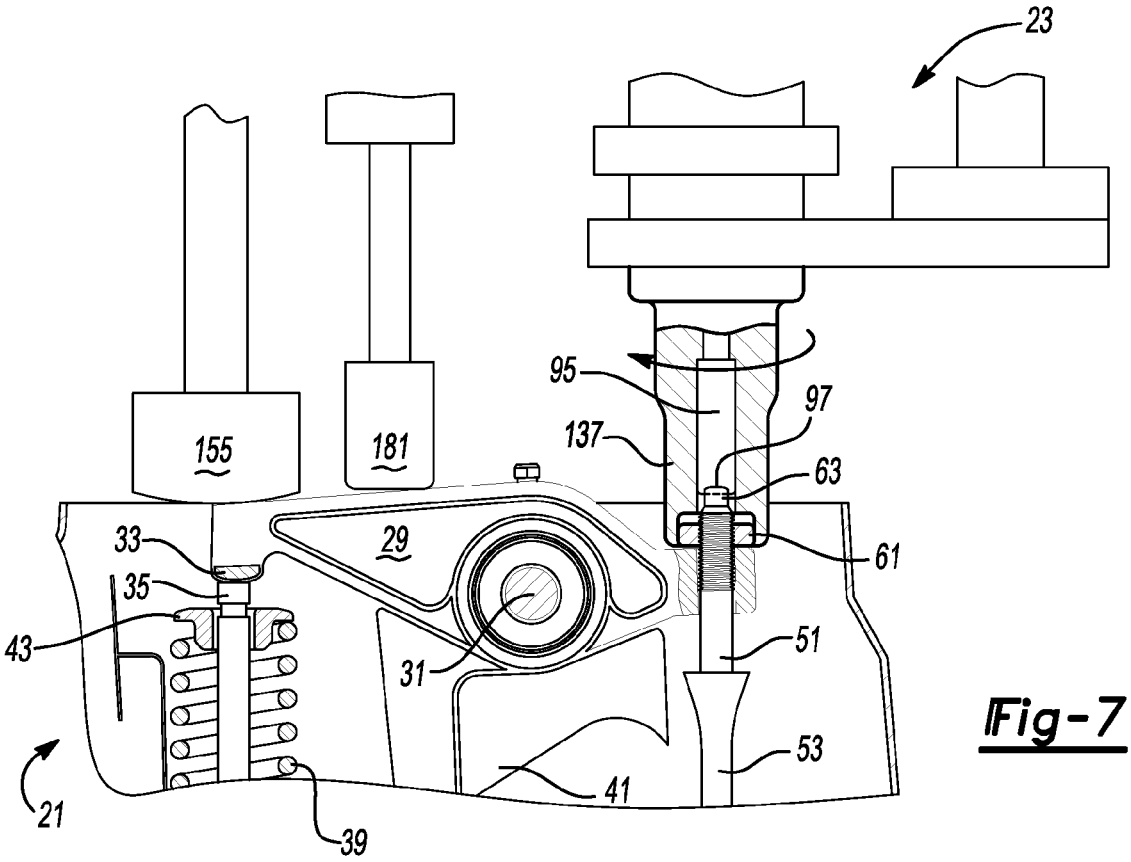
Figure 8:
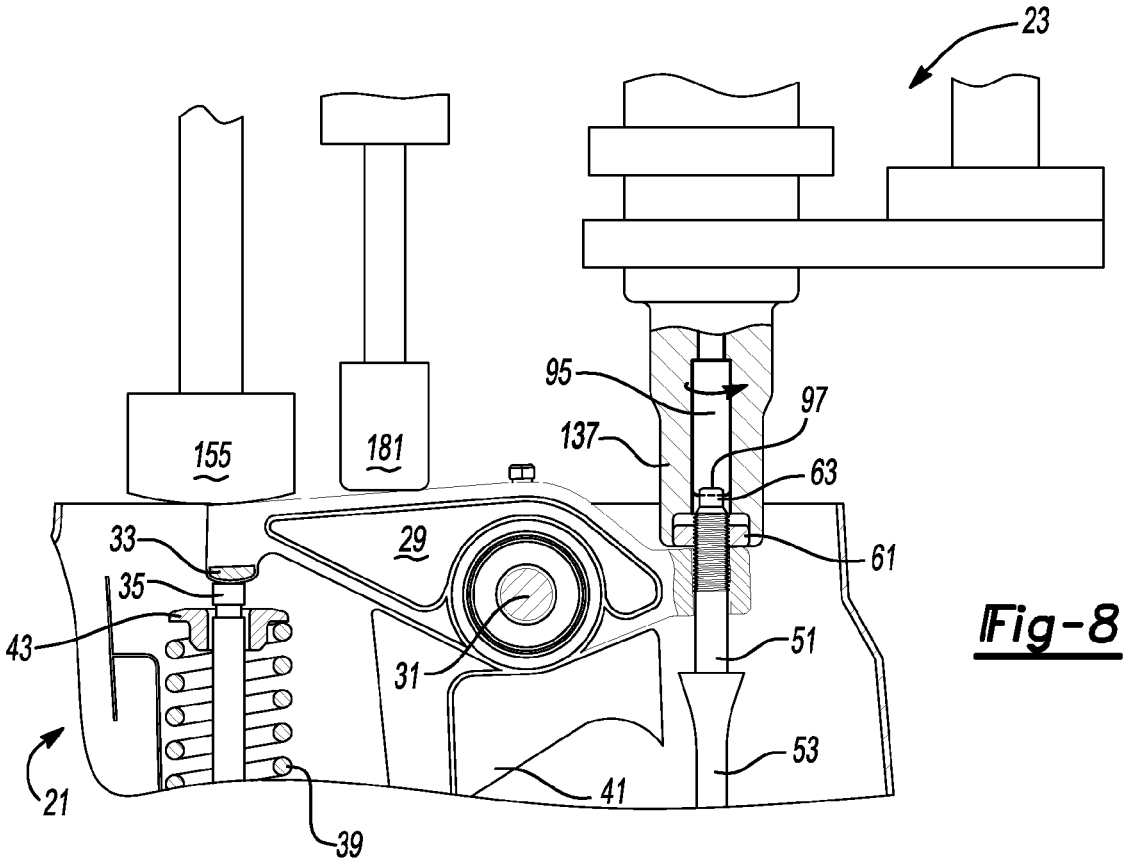
Figure 9:
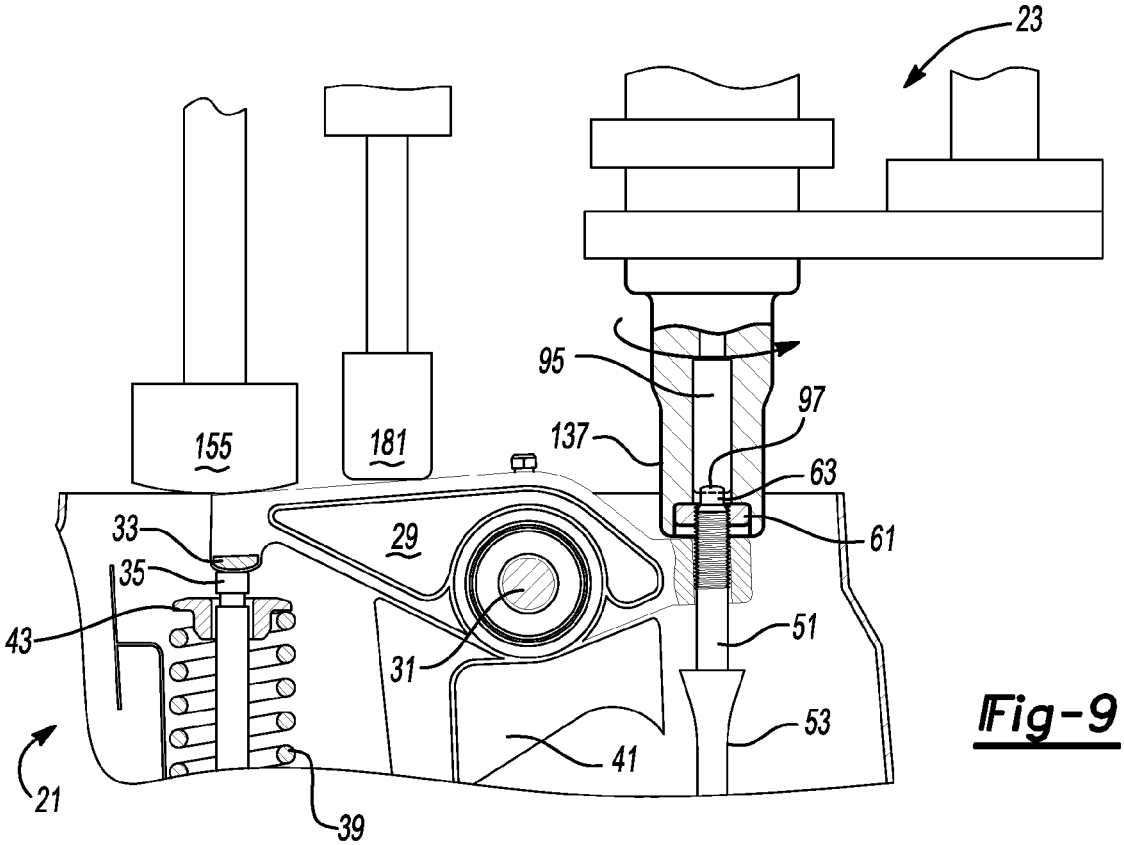
Figure 10:
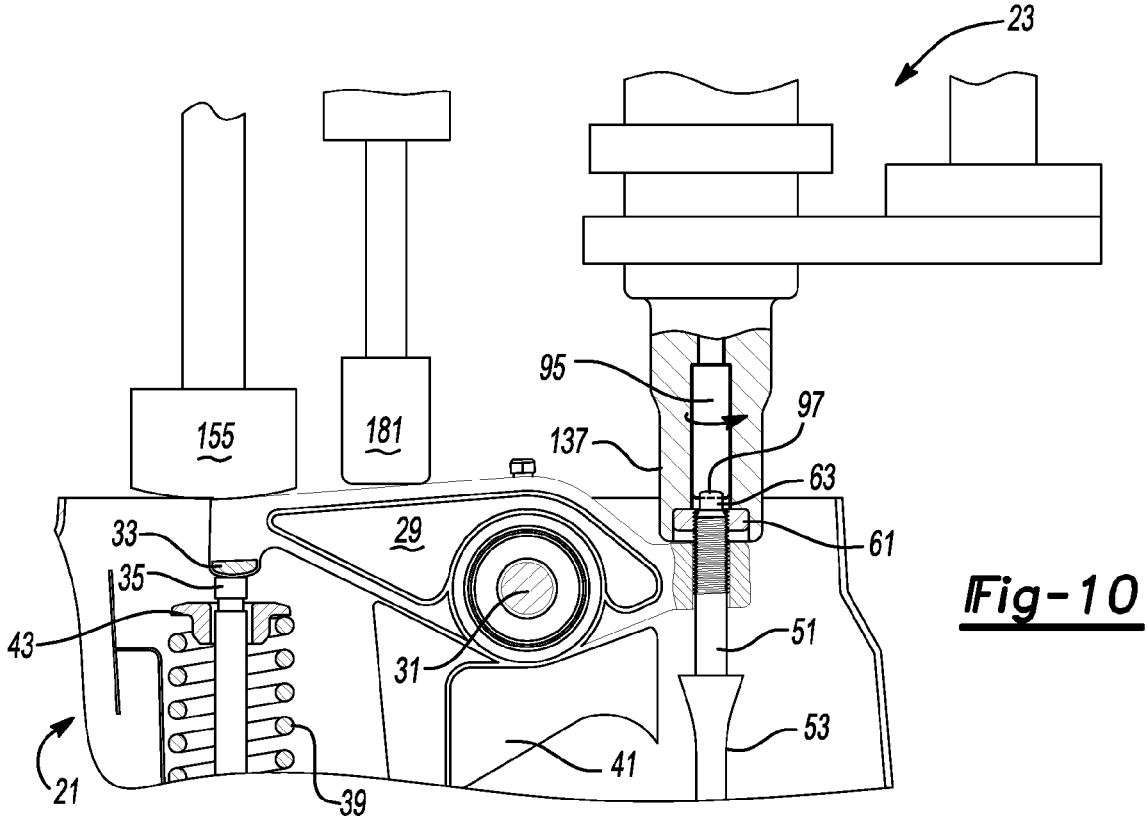
Figure 11:
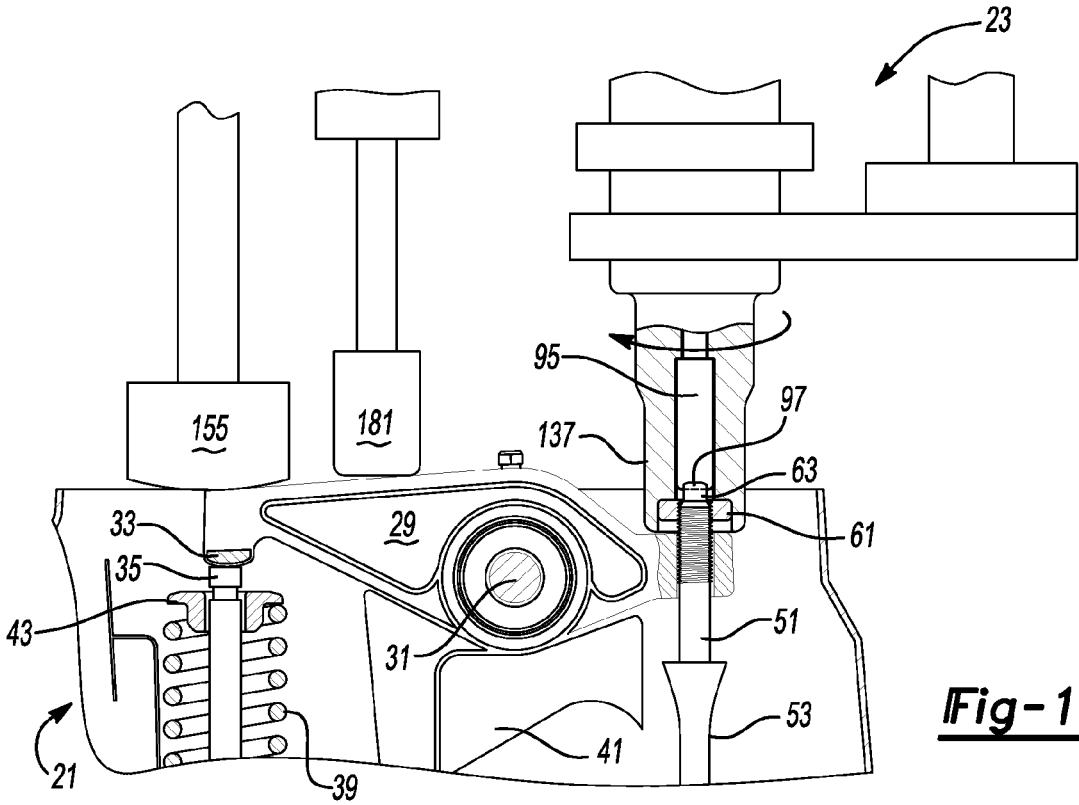

Referring to FIGS. 1-3, the preferred embodiment of the valve lash adjustment apparatus 21 includes a valve lash adjustment machine 23 and a workpiece such as a valve assembly 25 of an internal combustion engine 27. Such an engine can be for a passenger car, heavy-duty class eight truck, construction equipment, motorcycle or any other self propelled vehicle or stationary apparatus having an engine with valves. Valve assembly 25 includes a rocker arm 29 which is rotatable about a stationary shaft 31. A first end of rocker arm has a contact finger 33 which operably abuts against a valve stem 35 disposed at a distal end of a valve. Valve stem 35 is part of the valve. A lower end of a valve spring 39 contacts against a spring seat in an engine block 41 while an upper end of valve spring 39 upwardly biases a spring retainer 43 and the attached valve stem 35. An opposite end of rocker arm 29 has a threaded internal bore for receiving an externally threaded valve adjusting stud or screw 51 which is in axial contact with a push rod 53, coupled to a valve lifter or tappet 55. Valve lifter 55, in turn, rides on a rotatable cam shaft 57. A valve lash locking nut 61 is threadably engaged with an upper end of valve lash adjusting screw 51. Valve lash adjusting screw 51 further has a distal end 63 with a central groove, hexagonal shape, or other rotational driving tool engaging formation.

The detailed internal construction of valve lash adjustment machine 23 of the present invention apparatus 21 can best be observed in FIG. 2. A computerized controller 71, having a microprocessor, memory, an input programming device such as a keyboard and an output device such as a CRT, is electrically connected to a first electric motor 73 with a torque capability of about 10 Nm and a second electric motor 75 of torque capability in the order of 80 Nm. A first angle sensing encoder 190 is coupled to motor 75 and a second angle sensing encoder 192 is coupled to motor 73. Electric wires 76 connect the motors to controller 71 and electric wires 78 connect the encoders to the controller. First and second gear box portions 77 and 79 of the respective electric motors 73 and 75 are also provided. The motor 73 and gear box 77 are mounted to a motor adapter 81 which, in turn, is mounted to a motor mounting plate 83 and side plates 85. Motor 75 and gear box 79 are mounted to plate 83. A bearing housing 87, a bearing cap 89 and a spindle housing 91 are also mounted to side plates 85 or each other in a protective manner. The plates are mounted to a linear slide 92 (see FIG. 1) or the like which can be moved in a parallel direction to the adjusting screw axis and in an automated manner as part of a processing stop station on an assembly line which moves workpieces, such as engine 27 (also see FIG. 1) relative to valve lash adjustment machine 23.

A first output shaft 94 driven by first gear box 77 operably rotates a spindle shaft 96 which in turn, rotates a spindle shaft 93. Spindle 93 operably rotates a screwdriver-like or socket head wrench-like bit 95 having a flat or hexagonal blade 97 (see FIG. 3), or other rotary drive wrench-like adapter. Needle bearings 101, bearing spacers 103, internal compression spring 105, ball bearings 107, spacers 109 and auxiliary compression springs 111 are also provided. Furthermore, an electric brake 113 is employed to maintain first motor 73 and the associated first transmission in a desired position through electromagnetism when energized.

A second transmission operably driven by second electric motor 75 and gear box 79 includes a second output shaft 120 coupled to a driving gear shaft 121 which rotates a driven gear shaft 123 which is coaxially aligned with and surrounding a section of spindle shaft 96. Driving gear shaft 121 is enmeshed with driven gear shaft 123 by peripheral gear teeth. An external hex housing 131 is bolted to a structure rotating with driven gear 123. Housing 131 is concentric with an extension section 133 of spindle shaft 96. A socket sleeve 135 is rotatably coupled to housing 131, and is externally concentric with spindle shaft 93. Spindle shaft 93 and socket sleeve 135 are individually telescopic. A compression spring 99 outwardly biases socket sleeve away from housing 131 and driven gear 123, however, socket sleeve 135 can be forcibly retracted approximately 76 millimeters into housing 91 to the position 135'. A hexagonal socket 137 is rotatably driven by and secured to socket sleeve 135 and concentrically surrounds bit 95. Thus, bit 95 is driven by first electric motor 73 while socket 137 is mechanically independently driven by second electric motor 75.

A probe assembly 151 and a plunger assembly 153 are also mounted to linear slide 92 (see FIG. 1). Probe assembly 151 includes a probe 155 having an enlarged head 157 and a guide rod 159. Guide rod 159 is retractably received within a bore located in a bottom (as illustrated) of a mounting block 161 and is outwardly biased therefrom by a compression spring 163. A set of spring biased and coaxial shafts 165 couple head 157 to a linear variable differential transformer (hereinafter "LVDT") 167 or other linear measurement device (e.g., a digital sensor) which operably senses any movement of probe 155 during the valve lash adjusting procedure. LVDT 167 is electrically connected to controller 71 and sends an appropriate signal to the controller indicative of the probe deplacement and, in turn, the adjacent rocker arm position.

Plunger assembly 153 includes a plunger 181, which is free to move axially in plunger assembly 153, a coupling assembly 183 and a cylinder and piston assembly 185. The piston within the pneumatic cylinder is operably moved in a linear manner by directing fluid flow direction and pressure within the cylinder in order to advance and retract plunger 181 toward and away from rocker arm 29.

The preferred embodiment of the present invention valve lash adjustment apparatus employs the following substantially sequential method of operation which is illustrated in FIGS. 3-12B. Initially, the first set of valves to have the lash adjusted are closed by use of a robot or other mechanism to automatically rotate the crankshaft until a cam shaft related signal (such as from a raised valve) indicates proper positioning.

Step 1—Engage Valve Lock Nut Socket (See FIG. 3):

(a) Locate the valve lash machine to an operating position adjacent the engine block at the work station and contact rocker arm 29 with probe 155;

(b) send a signal from the controller to automatically energize the second electric motor 75 to rotate the outside spindle and socket 137 in a clockwise tightening direction (assuming right hand threads for all directional examples described and shown herein);

(c) engage the nut with socket 137; and (d) automatically tighten lock nut to a predetermined torque of approximately 5 Nm.

The controller of the system monitors the applied or actual torque by a transducer-type torque sensor 186 coupled to the second motor, a predetermined range of high/low torque limits are set for acceptable values (for example, +/−1 Nm), and socket rotation is then automatically stopped when the sensor actual torque is within the desired range.

Step 2—Engage Valve Screw (Stud) (See FIG. 4):

(a) The controller sends a signal to energize the first electric motor to rotate the inside spindle which engages blade of bit 95 with valve lash adjusting screw 51, by rotating bit 95 in a clockwise tightening direction, as for the prior nut tightening step 1, to an applied torque of approximately 1.5 Nm; and (b) the controller of the system confirms engagement by monitoring the applied torque, through a transducer-type torque sensor 188 coupled to the first motor. A controlled set point and high/low limits identify acceptable values when the final torque value is reached, and the bit rotational drive is automatically stopped.

Step 3—Back-Off Nut (See FIG. 5):

(a) The controller automatically applies the brake to the inside spindle 93 in order to keep bit 95 and adjusting screw 51 from rotating; and (b) the lock nut is backed-off a predetermined amount by automatically rotating socket 137 and nut 61 in an opposite (e.g., counterclockwise) direction from that of step 1. This utilizes angle controlled rotation of approximately 1800 as determined by encoder 190.

Figure 13:
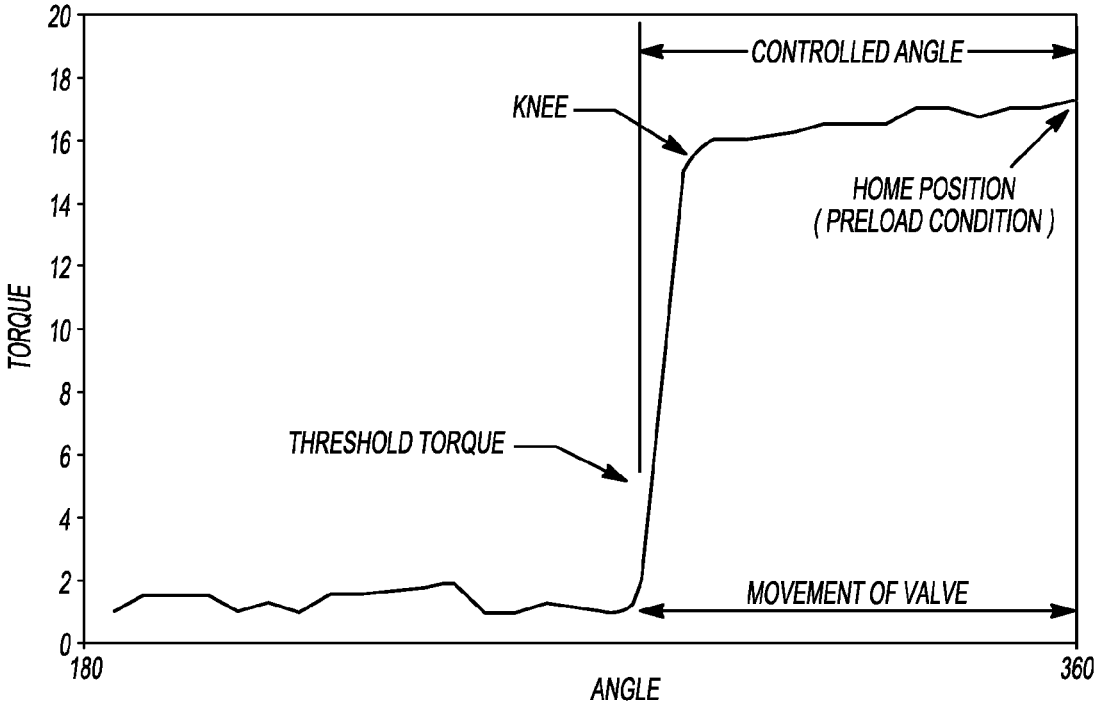
FIGS. 13-17 are graphs of valve lash setting data employed with the preferred embodiments of the valve lash adjustment apparatus and method.

Step 4—Set Adjusting Screw (Stud) to Home Position (A Preload Condition) (See FIG. 6):

(a) Cylinder 185 (see FIG. 2) is automatically actuated to cause plunger 181 to bias rocker arm 29 toward the valve;

(b) The controller automatically rotates the inside spindle 93 and bit 95 in a clockwise direction until the controller of the system confirms the end position (where the valve is lifted off the valve seat) by monitoring the applied torque (through the first motor sensor), and angle (through encoder 192, see FIG. 2), to a controlled angle set point (for example, 180°) past reaching an angle measurement start, i.e., threshold torque value (see FIG. 13). In other words, the angle initialization begins in the controller when the threshold torque is sensed. High/low range limits are set for acceptable angle values. Alternately, brushless motor Hall effect sensors or other sensors can be used in place of encoders 190 and 192; and (c) Probe 155 verifies that movement of rocker arm 29 compressing valve spring 39 is occurring and is proportional to a desired, predetermined value associated with the angle set point (preferably 180°). If the probe detects movement at the beginning of angle rotation, the rotation is stopped and this condition indicates that the valve is in an open condition; at this point, the motor is energized in a counterclockwise direction for 180° to ensure that the valve is closed. The process will then repeat all of step 4.

Figure 16:
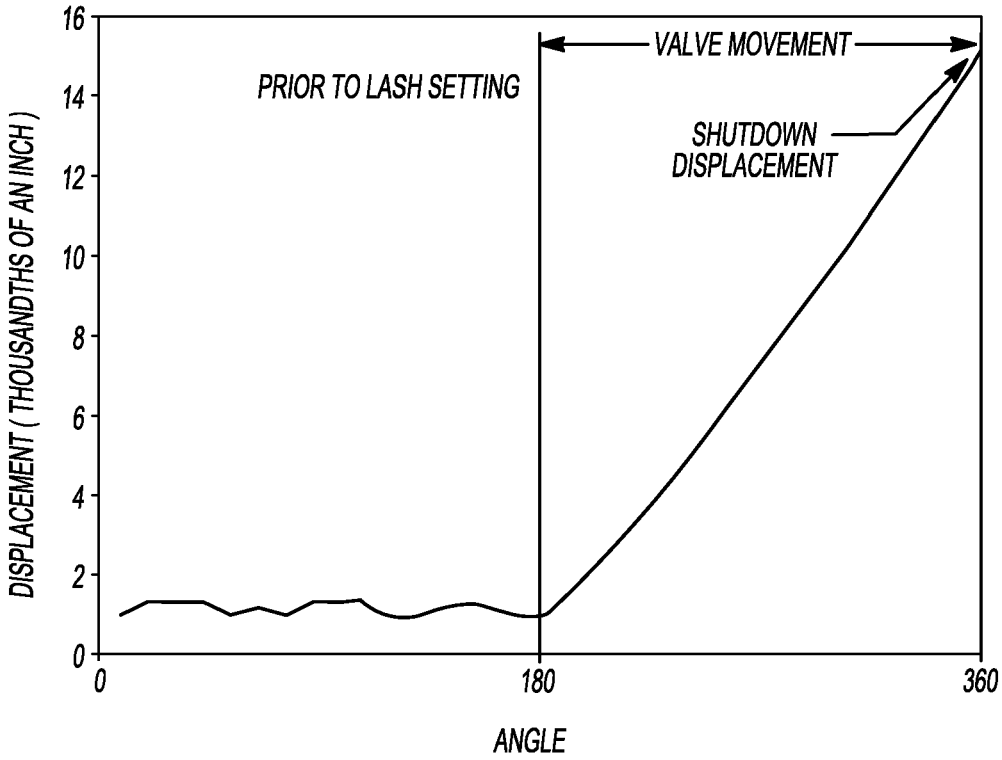

In an alternate variation, probe 155 measures the shutdown displacement or preload position value of 0.015 inch, by way of example, at which point the controller deenergizes the motor 73, as shown in FIG. 16. Thus, the probe is used instead of an angle value from a torque threshold. Furthermore, the probe is used in situations where the torque value needed to compress the valve is very low (for example, with small passenger car internal combustion engines); but the angle from the torque threshold version, with verification of rocker arm movement, is more desirable for larger diesel engines (i.e., to verify the home/preloaded position without setting an initialized zero position). If the probe method is used then there is no need for steps 5, 6 and 7.

Step 5—Tighten Lock Nut (See FIG. 7):

(a) The controller automatically applies the brake to the inside spindle in order to keep bit 95 and screw 51 from rotating; and (b) The controller then automatically energizes second motor 75 in order to torque socket 137 and lock nut 61, in the same (e.g., clockwise) rotational direction as for step 1, to a low torque value of approximately 5 Nm. The system is utilized in torque control mode and high/low range limits are set for acceptable values. Torque control mode means rotating motor 75 and keeping it energized until a desired torque value is reached.

Step 6—Eliminate Adjusting Screw (Stud) Bit 63 "Gap" (Free Play) (See FIG. 8):

(a) The controller automatically rotates the inside spindle and blade bit 95, in a direction opposite that of step 4 (e.g., counterclockwise), to eliminate free play between blade 97 and the adjacent slot wall 63 of screw 51 and backlash within the machine transmission. The controller of the system identifies "no" mechanical gap by: monitoring torque with sensor 188 (shown in FIG. 2) as the bit blade meets the adjusting screw slot 63 and comparing the sensed torque signal value to a predetermined, desired value at which point drive motor 73 is deenergized. The sensed torque value is compared and high/low torque range limits are set for acceptable values.

Step 7—Back-Off Nut (See FIG. 9):

(a) The controller automatically applies the brake to the inside spindle in order to keep bit 95 and adjusting screw 51 from rotating; and (b) the controller then automatically energizes the second motor to rotate socket 137 in the opposite direction of step 1 (e.g., counterclockwise) in order to back-off lock nut 61. The system utilizes angle control for the degrees of revolution and high/low range limits are again set for acceptable values.

Step 8—Set Lash (See FIG. 10):

(a) The controller subsequently automatically energizes first motor 73 in order to rotate the inside spindle and bit 95 in a counter-clockwise direction for 180° (i.e., the amount of preload into valve from step 4) plus an additional amount of degrees necessary to cause the appropriate valve lash desired for the particular application (see FIG. 14); and (b) the controller of the system confirms the rotation by counting the degrees of spindle rotation which are checked against high/low angle range limits set for acceptable values.

There are three preferred systems and methods of setting valve lash and verification with regard to step 8. The first is the displacement versus angle embodiment with an inflection point determination, the second is the torque versus angle embodiment, and the third is the total displacement versus angle embodiment. For the first lash setting (shown in FIG. 17) and verification embodiment using torque and rotational angle (further shown in FIG. 14), control of the motor is being correlated to the probe displacement and motor angle movement. Plunger 181 is advanced and the angle of rotation after the knee then is measured as in FIG. 17. When the angle after the knee reaches the desired value, motor is subsequently deenergized. Verification is performed by the total amount of angular rotation created by the motor (see FIG. 14).

Figure 17:
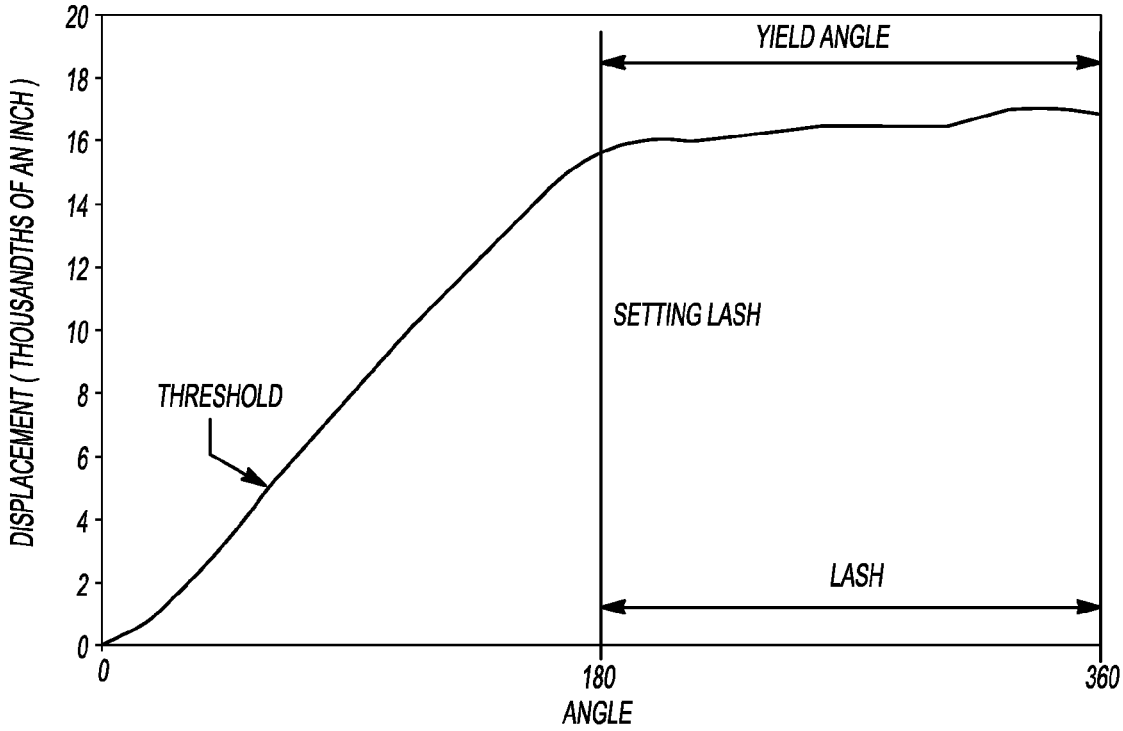

In the probe displacement versus angle version for verification, the displacement is monitored by probe 155 with respect to the angular rotation of the electric motor as sensed by encoder 192, which generates a displacement versus angle curve as shown in FIG. 17 based on calculations or determinations by the controller. When the controller determines occurrence of a significant change in the sensed slope of the curve as indicated by a knee, angular rotation will continue a certain number of rotational degrees beyond the knee to obtain the proper valve lash.

For the second lash setting (see FIG. 14) and verification embodiment (see FIG. 15 or 17), control of the motor is done by motor angle movement. Inside motor 73 rotates counterclockwise the angular amount from Step 4 plus the angular amount required for the desired lash. Verification can be done two ways: (i) plunger 181 is advanced and the angle of rotation after the knee is measured, as in FIG. 17; or (ii) plunger 181 is retracted and the rocker arm is biased toward push rod 53 by the springs in the coaxial tool. Displacement is measured as in the graph of FIG. 15. It includes the measurement from step 4 (see FIG. 18) plus the actual lash distance.

For the third lash setting (see FIG. 15) and verification embodiment (see FIG. 14) of step 8, control of the motor is being done by linear displacement of the probe. Plunger 181 is retracted and the rocker arm is biased towards push rod 53 by the springs in the coaxial tool. The displacement distance is measured as is displayed in the graph of FIG. 15. It includes the measurement from step 4 (see FIG. 18) plus the actual lash distance. When the desired displacement value is achieved, the motor is then deenergized. Verification is performed by the total angular amount turned by the motor (see FIG. 14).

Step 9—Tighten Nut (See FIG. 11):

(a) The controller automatically applies the brake to the inside spindle in order to keep bit 95 and valve lash adjusting screw 51 from rotating; and (b) the controller automatically energizes the second motor thereby rotatably torquing nut 61 with socket 137. The system is utilized in torque control mode and final torque is checked against the high/low range limits set for acceptable values.

Step 10—Verification (See FIG. 12A):

(a) Plunger 181 is advanced, thereby bringing rocker arm end 33 into contact with valve stem 35;

(b) Thereafter, the controller automatically zeroes the position value of the output signal of the LVDT actuated by probe 155 then retracts plunger 181 (see FIG. 12B); thereafter, the springs bias rocker arm 29 onto contact with push rod 53; and (c) finally, the controller reads a position signal sent by the LVDT coupled to probe 155). The verification procedures can be used with any of the embodiments disclosed herein.

Throughout the preceding steps, anytime the outer spindle is rotated by its motor 75, a braking effect is applied to motor 73 to prevent rotation of bit 95, and adjusting screw to occur while the nut is being rotated.

Figure 12A:
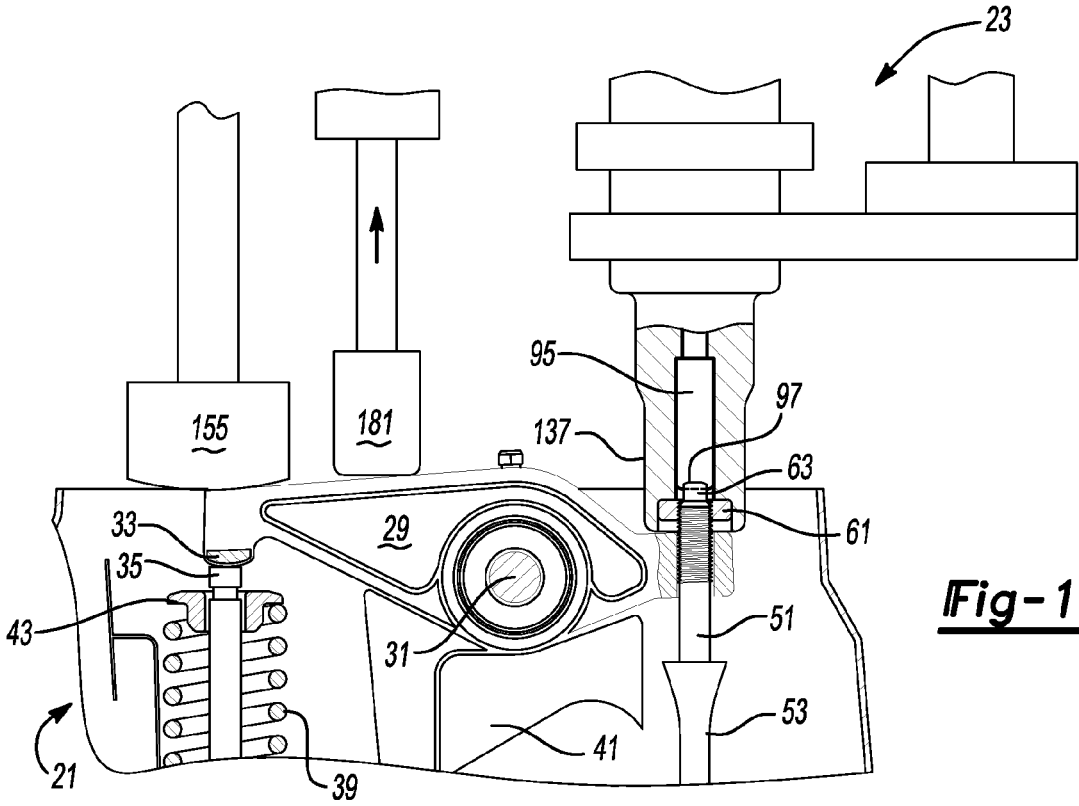
Figure 12B:
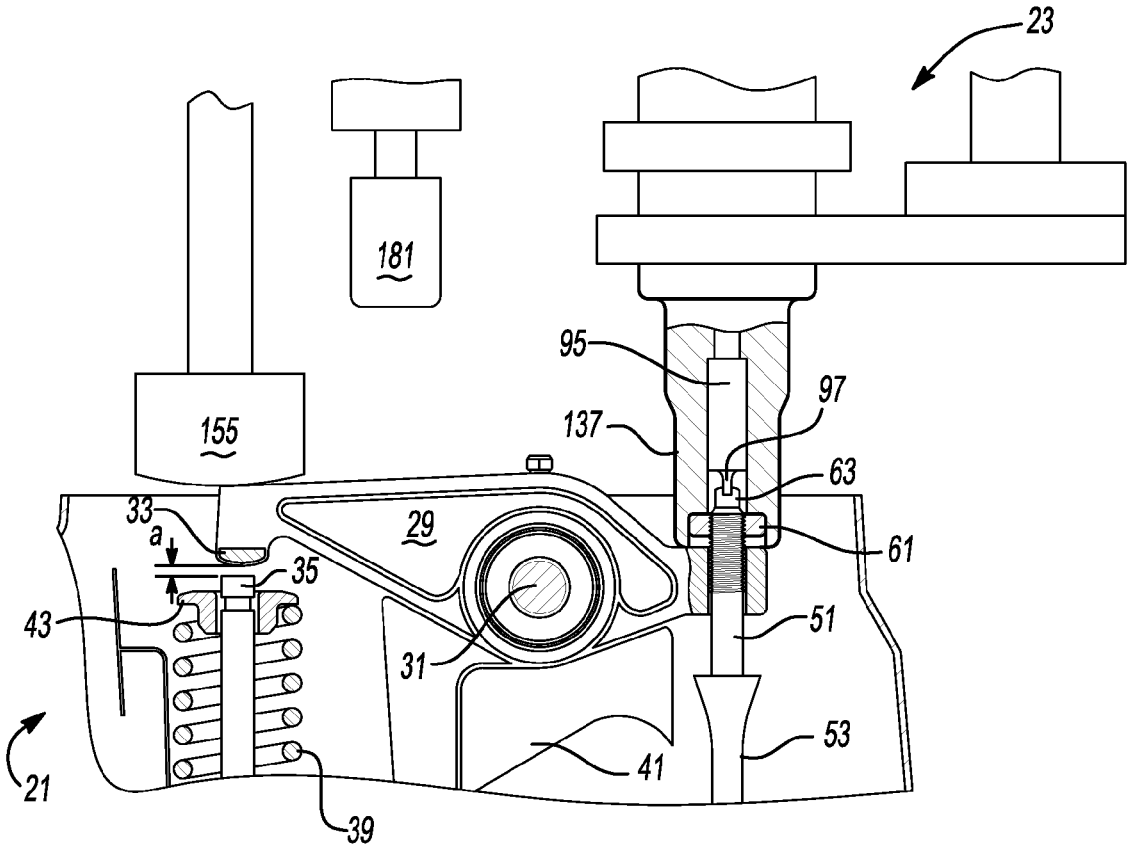

FIG. 12B illustrates the final measurement step, after the verification zeroing out step of FIG. 12A. In this final measurement step, spring 99 within machine 23 (see FIGS. 1 and 2) biases rocker arm 29 toward push rod 53. This causes probe 155 to upwardly move such that LVDT 167 displacement measures the actual set valve lash "a" at FIG. 12B. This is input into the controller and compared to the predetermined desired valve lash setting range. If the actual reading is acceptable then apparatus 21 retracts and either the next valve (s) is/are acted upon or the next engine workpiece is moved into the valve lash setting station. If the actual reading is not acceptable then the controller will automatically repeat steps 3 through the final step a predetermined number of iterations (for example, two or three times). If the setting is still unacceptable then the controller will note the defective part (through an error message, alarm signal or the like) and/or will automatically cause the engine to be conveyed to a repair area for manual reworking. This readjustment step can also (or instead) occur at the end of steps 4 (an intermediate readjustment) and/or 8 (an end readjustment). In the event that a prevailed torque type screw is used, then only the above discussed probe versions will be employed as in steps 4 and 8.

Figure 14:
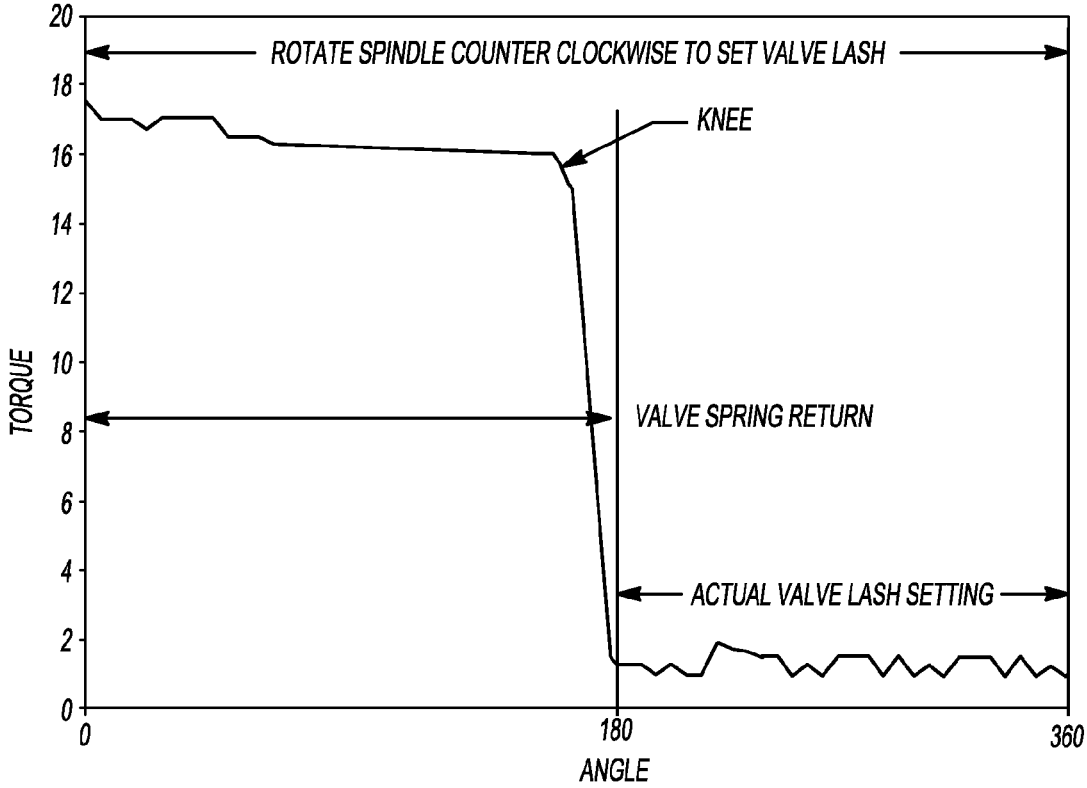
Figure 15:
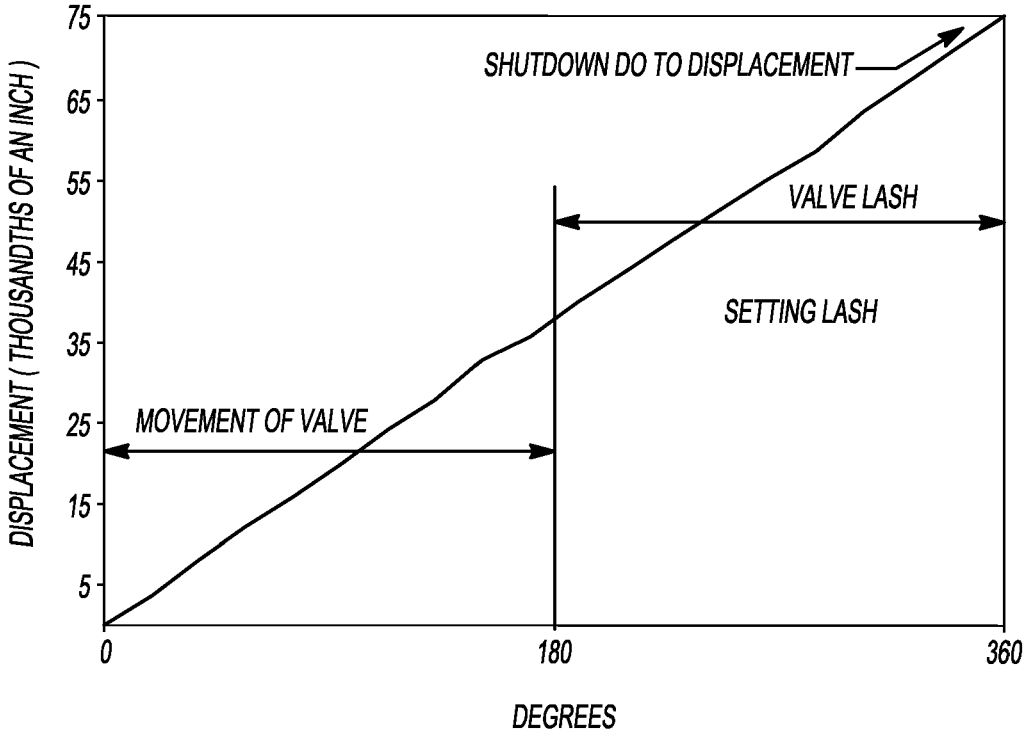
Figure 20:
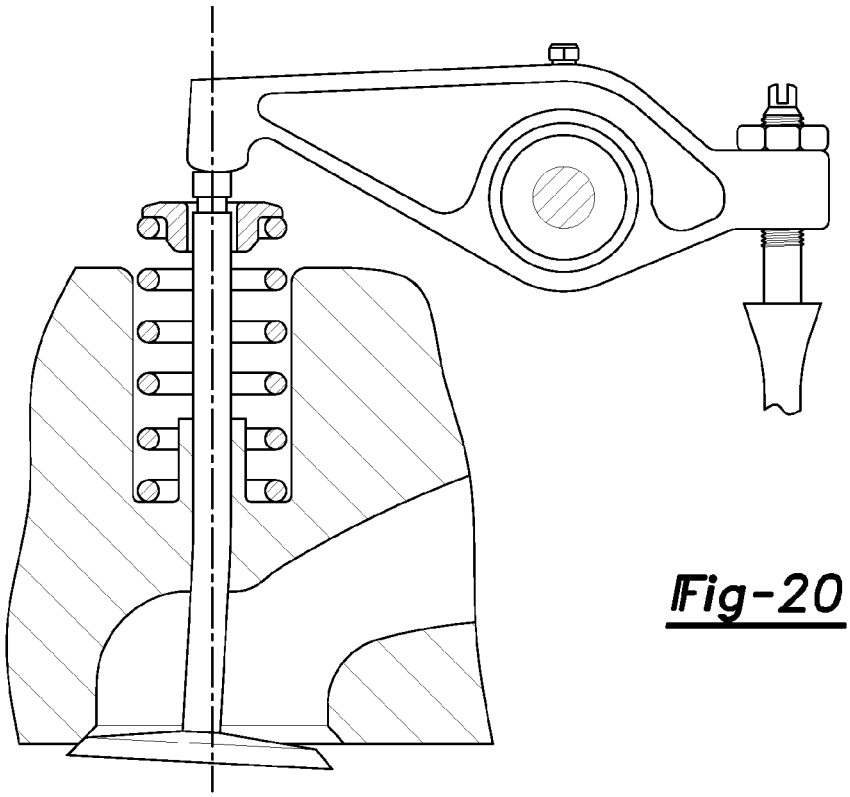
FIG. 20 is a partially fragmented and side diagrammatic view showing the preferred embodiments of the valve lash adjustment method applied to a bent valve stem situation.
Figure 21:
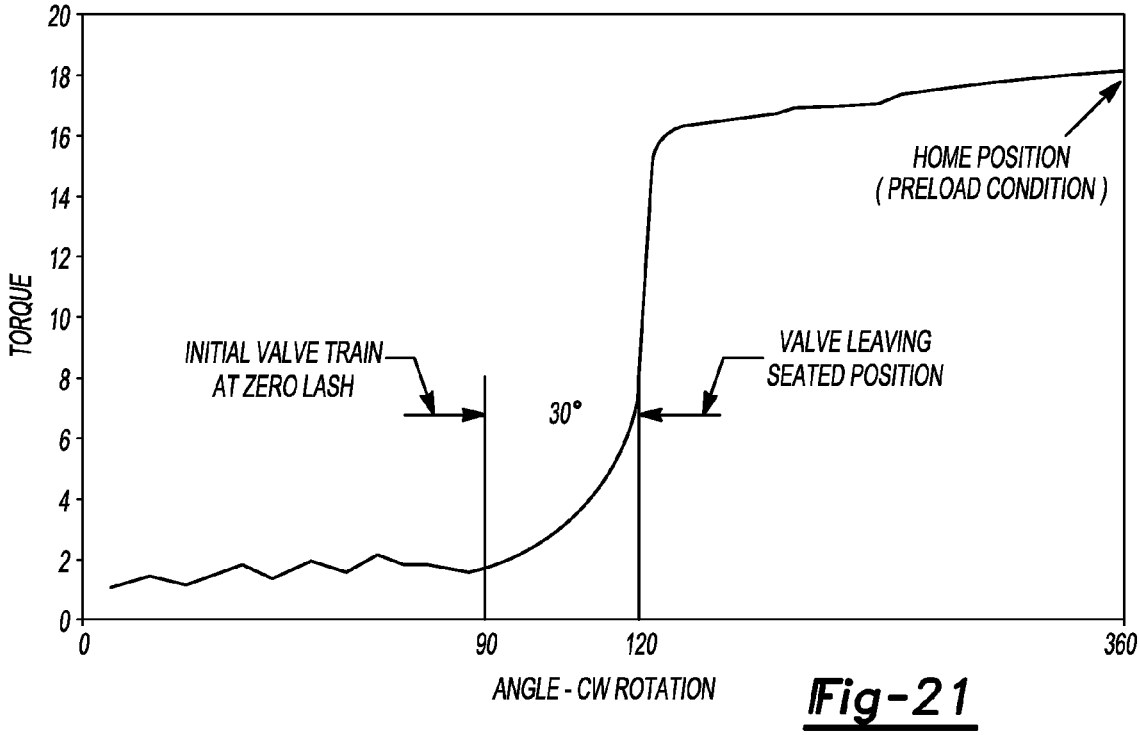
FIGS. 21 and 22 are graphs illustrating the preferred embodiments of the valve lash adjustment method applied to the bent valve stem situation.
Figure 22:
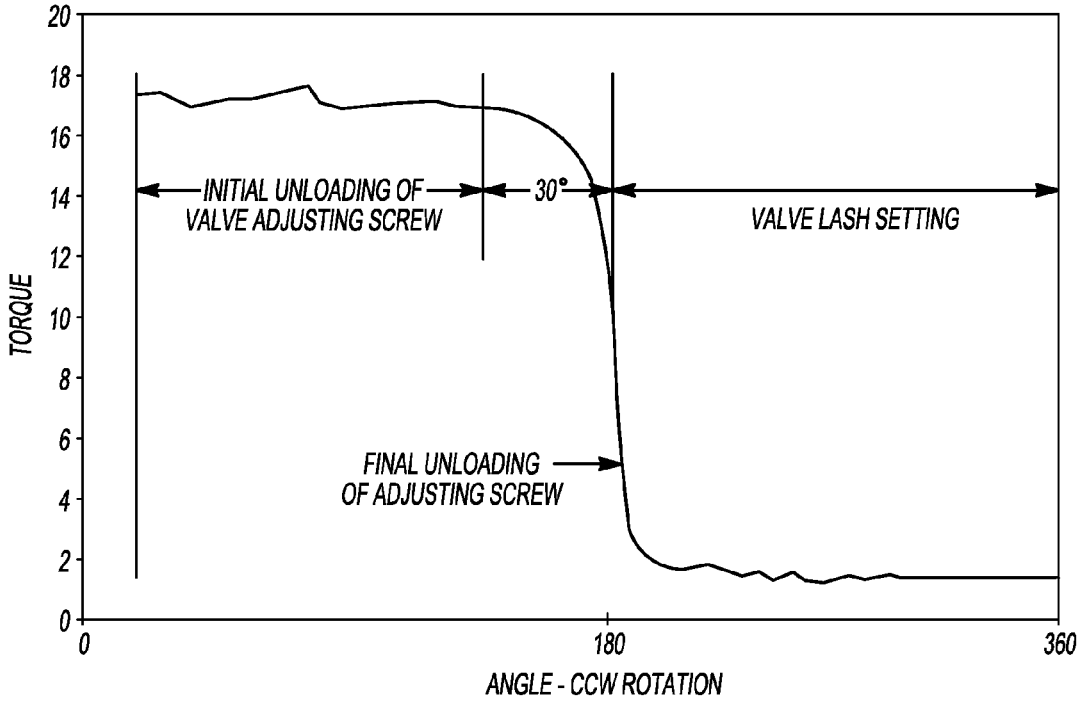

FIG. 20 shows an improperly seated valve, for example, a bent valve stem; the fault could be due to an eccentric condition or foreign material. As the valve is lifting off the seat or when seating, the deflection in the valve stem will counteract the valve spring force, thus, reducing the apparent valve spring load during seating or unseating transition. The counteracting force from the valve deflection is gradual such that a resulting knee, or change, in a torque/rotation curve, torque/displacement curve, or displacement/angle curve, will be more gradual. This will result in a significant reduction in the second derivative value. Accordingly, the sensed data values as determined by the controller, and when plotted like FIGS. 21 and 22, can be used as an inspection parameter. In these graphs, FIG. 21 is similar to FIG. 13 (which used a properly preloaded valve), plotting Step 4, but instead uses data points expected from a faulty valve seating situation. FIG. 22 is similar to FIG. 14, plotting Step 8, but instead uses data points expected from a faulty valve seating situation. A special output signal can then be sent by the controller indicative of a faulty valve seating condition, such as a warning light, screen display text or the like. The angular data shown throughout is merely exemplary and not from test results.

The first alternate probe embodiment of the present invention as briefly discussed for steps 4 and 8 above are further described in greater detail below. The method and machinery apparatus are similar to that disclosed in U.S. Pat. No. 3,988,925 (Seccombe et al.) except for the following significant differences:

(a) In the apparatus and method of this invention, the locknut, if any, is loosened and the adjusting screw is rotated in the forward (e.g., clockwise) direction until the probe monitoring the axial position of the valve stem records motion of some predetermined increment to insure that the valve actuating mechanism is loaded by the force of the valve spring. This method doesn't require the step of backing out the adjusting screw or of recording an initial "zero" displacement reading of the axial position of the valve stem with the valve closed. It only requires sensing an increment of valve opening movement (see FIG. 13).

(b) Next, in this invention embodiment, the drive of the adjusting screw is reversed (e.g., rotated counterclockwise) bringing the valve to a closed position. When the valve reaches its closed position, the signal from the valve stem axial position sensing device will stop indicating change. From the point where the signal from the valve position indicator stops changing; further counterclockwise rotation of the adjusting screw is monitored and rotation is continued an amount calculated to provide the desired valve lash. The lock nut, if any, is subsequently tightened.

It can be seen that the latter method has fewer steps and is simpler than the prior, traditional automatic methods. In addition to being simpler it advantageously requires less cycle time per valve. Furthermore, if the adjusting screw is already in a loose backlash condition when the engine enters this operation, it will not be loosened further possible causing other complications. In contrast, the original method in U.S. Pat. No. 3,988,925 required recording an initial valve closed position and after opening the valve a small amount, returning to that same position and reading it as the point from which to start the increment of rotation for the desired lash.

Experience has shown a small difference between the first recorded valve closed stem position and the measurement recorded on the next closing of the valve. To avoid the possibility of never reaching the first measured point, an offset has to be put into the first recorded position to insure a matching signal on the second sensing of valve position when the valve closes at the onset of adjustment rotation. This offset introduces an error which the method of the present invention avoids.

Figure 18:
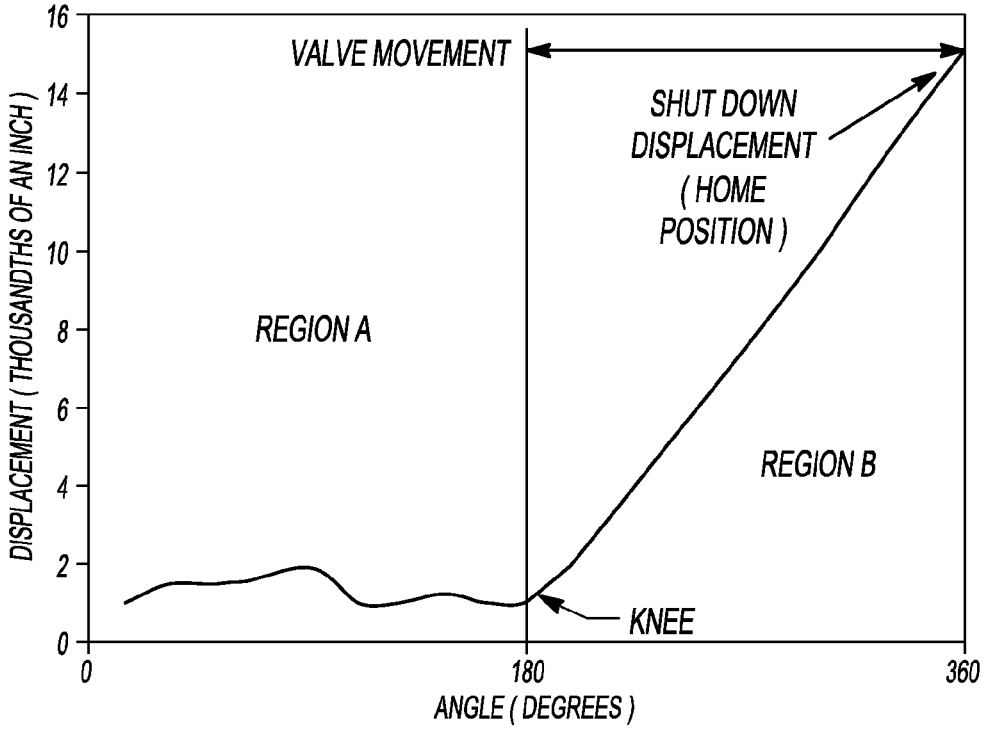
FIGS. 18 and 19 are graphs of valve lash setting data employed with a first alternate embodiment valve lash adjustment apparatus and method.

In addition to the above listed advantages, the new method has the ability of detecting incorrect seating of the valve. It utilizes the change in the knee of the curve of valve displacement over rotational displacement of the adjusting screw (displacement/rotation). For example, as the valve is opening in step (a) of the new alternate embodiment method, there will be a linear slope as is shown in FIG. 18. Region "A" indicates the adjusting screw is in a backlash condition and that rotation of the adjusting screw or stud 51 (see FIG. 3) is not moving the valve stem 37 (also see FIG. 3). The knee of the curve indicates the point at which all free play or back lash has been taken out and that the valve stem will move as the screw is advanced. In step (b) of the process, with the polarity of the valve stem displacement signal reversed, the displacement/rotation curve will appear as in FIG. 19.

The controller determines that in Region "A", as the adjusting screw is being rotated in reverse (counter-clockwise in the embodiment illustration, for example) and with the valve starting in a partially open position (see step (a)), the valve is moving towards a closed position. When the valve is closed, it is indicated by the knee in the curve where the curve transitions to horizontal. Movement (rotation) along Region "B" of the curve is proportional to the valve lash setting.

Sensing of the knee would be used as the starting point for measuring the adjusting screw or stud rotation for setting the lash. Incorrect valve seating will show as a variation in the rate of change (second derivative) of slope at the knee, as determined by the controller. A slow rate of change, as determined by the controller, would indicate faults that caused deflection of the valve head such as foreign material between the valve and valve seat, an eccentric or bent valve, and/or a valve seat eccentric to the valve guide. The slope (displacement versus angular rotation) of Region "A" in FIG. 19 should be directly proportional to the thread pitch of the adjustment screw or stud. This slope can be closely monitored by the controller for imperfections such as being non-linear that may affect the accuracy of the final lash setting.

An optional feature can be added to the automatic valve lash adjusting method of this alternate embodiment to verify the amount of lash as a separate measurement from that used in setting the lash. This is achieved by adding a second displacement transducer that monitors movement of the valve actuating rocker arm and by biasing the rocker arm with a light spring load so it follows the adjusting screw. This will keep the valve actuating mechanism in a zero backlash condition and all of the valve lash clearance will be between the valve stem and the rocker arm.

Figure 19:
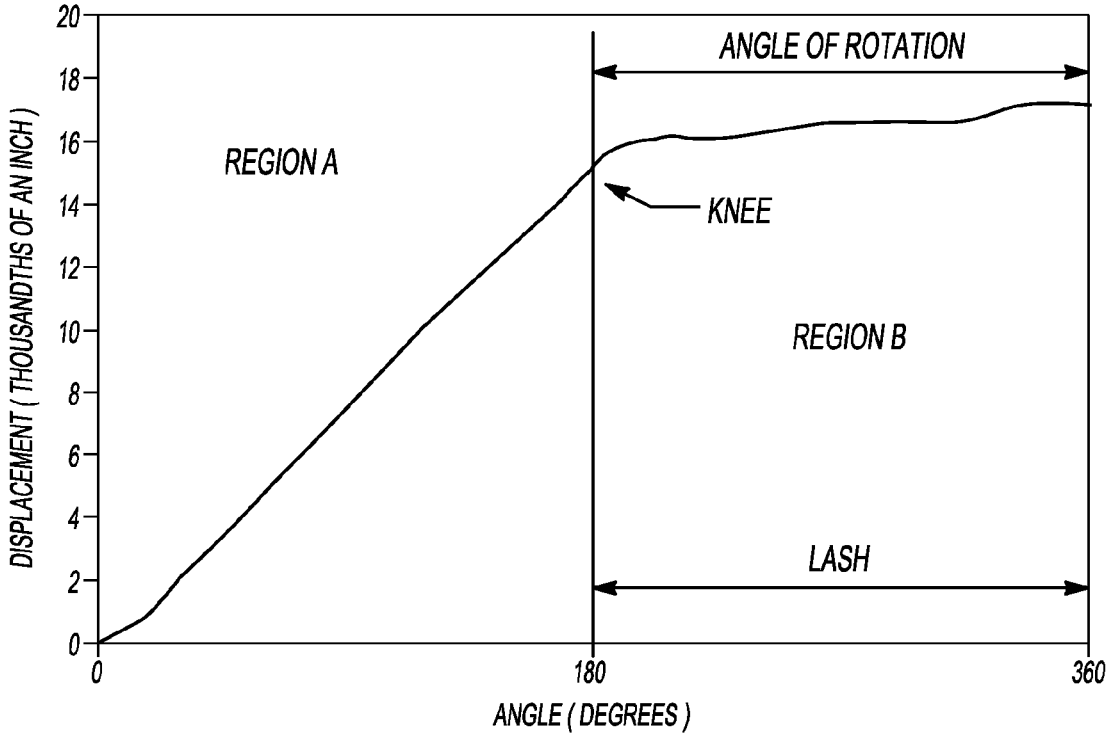

Thereafter, the rocker arm displacement will be proportional to the amount of lash by sensing the knee as shown in FIG. 19 and measuring the rocker arm displacement from that point. It can be seen that if the rocker arm design made it possible to measure rocker arm displacement on the centerline of the valve stem, valve lash and measured rocker arm displacement would be essentially equal. If, however, rocker arm displacement is measured at another point, a ratio can be used to calculate equivalent valve lash (as would be scaled between the valve stem and the rocker arm). An alternate point of contact for probe 155 is directly on valve spring retainer 43. This option may be necessary on some engines where the top surface of the rocker arm does not have a suitable surface or where the adjusting screw is over the valve stem end of the rocker arm. This option, however, would not provide for final lash check using the probe. Either the valve spring retainer displacement or the rotation of the adjusting screw (from the knee of the curve indicating point of valve seating) could be used as the control for making the adjustment and the other measurement/rotation used as an adjustment verification check.

Figure 23:
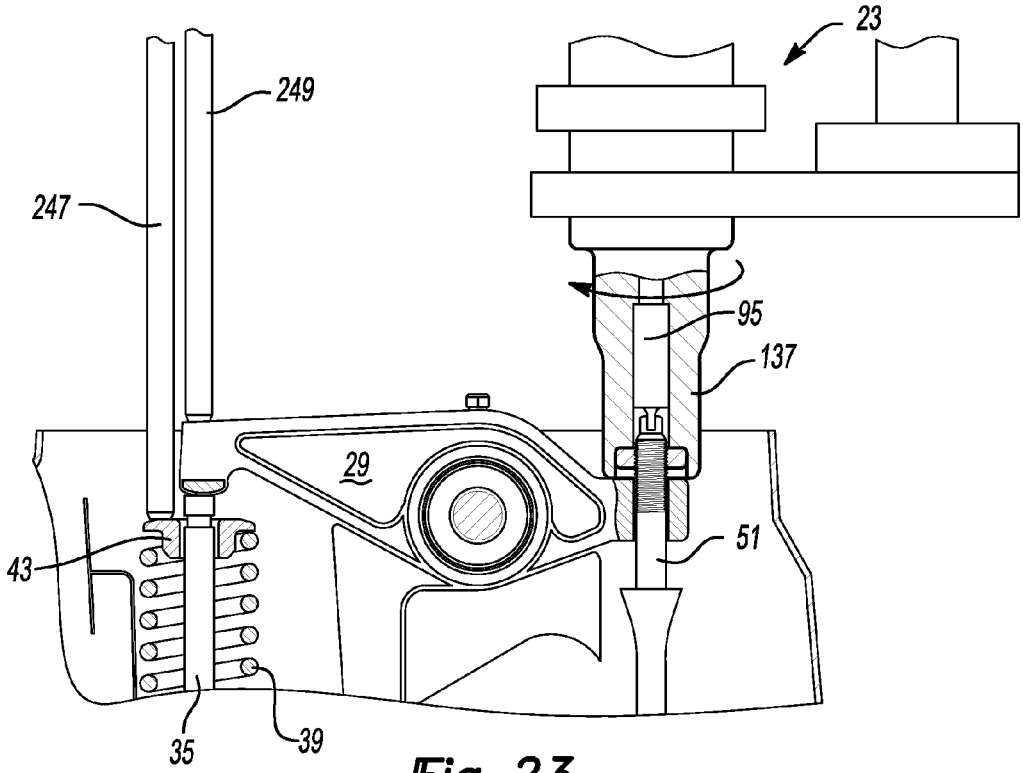
FIG. 23 is a partially fragmented and side diagrammatic view showing a second alternate embodiment of the valve lash adjustment apparatus and method of the present invention.
Figure 24:
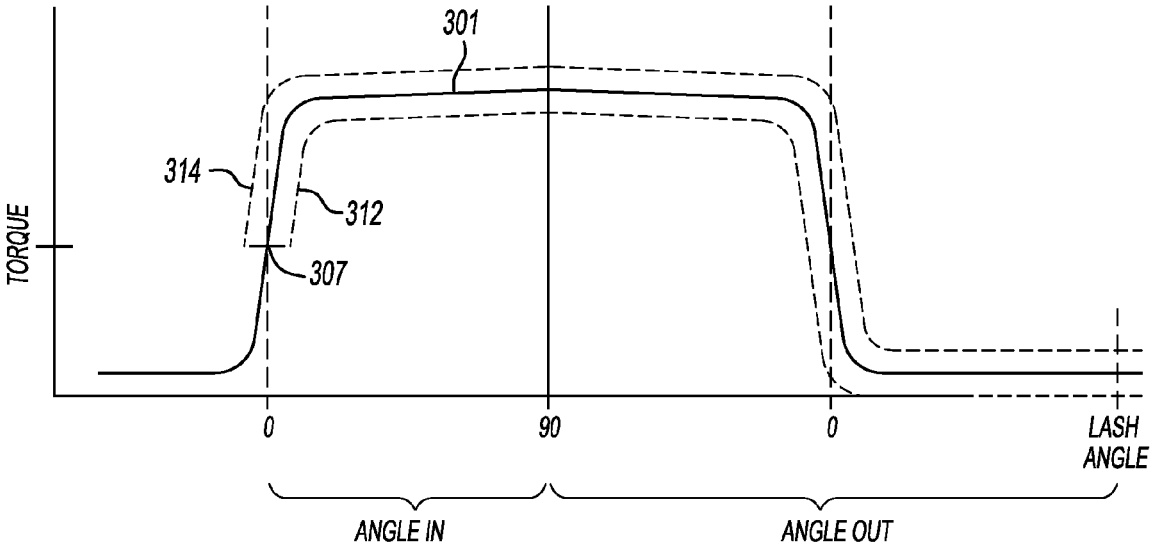
FIG. 24 is a graph depicting valve lash setting data employed with an alternate embodiment valve lash setting method.

A second alternate embodiment valve lash setting machine and method are illustrated in FIG. 23. The machine is like that used with the preferred embodiment shown in FIG. 1 except for the measuring probe configuration and computer software to control and monitor same. A first linearly extendable probe 247 and a second linearly extendable probe 249 are employed with the present embodiment. A distal end of first probe 247 contacts against spring retainer 43 of the valve assembly while a distal end of second probe 249 contacts against an upper surface (as shown) of rocker arm 29 adjacent spring 39, when both probes are automatically extended as coordinated by the controller. The preferred embodiment steps are employed except as follows. The rocker arm is biased towards the push rod by springs in coaxial tool 23. In step 4, the controller causes driver bit 95 to rotate an adjuster, here valve lash adjusting screw 51, until first probe 247 begins to move, as sensed by a LVDT coupled to the probe 247 which communicates the appropriate linear displacement signal to the controller. While rotating the valve lash adjustment screw, second probe 249 is passively moved by rocker arm 29 in accordance with the valve lash screw rotational adjustments. Then, in step 8, the valve lash setting determination is made by the controller sensing, comparing and/or calculating the linear distance differential of the probes 247 and 249, and determining that the difference in actual measured distance is the actual valve lash. This provides a very direct valve lash measurement and determination while minimizing complex geometric calculations and intermediate part tolerance variables.

FIGS. 24-28 relate to an alternate method 300 of setting the valve lash in an internal combustion engine. The method provides a properly adjusted valve having a predetermined clearance or lash between the valve and its associated rocker arm. This method includes a real-time verification procedure that alleviates the need for additional plungers and/or sensors operable to move the rocker arm and collect displacement data of the rocker arm during movement through the lash.

Figure 25:
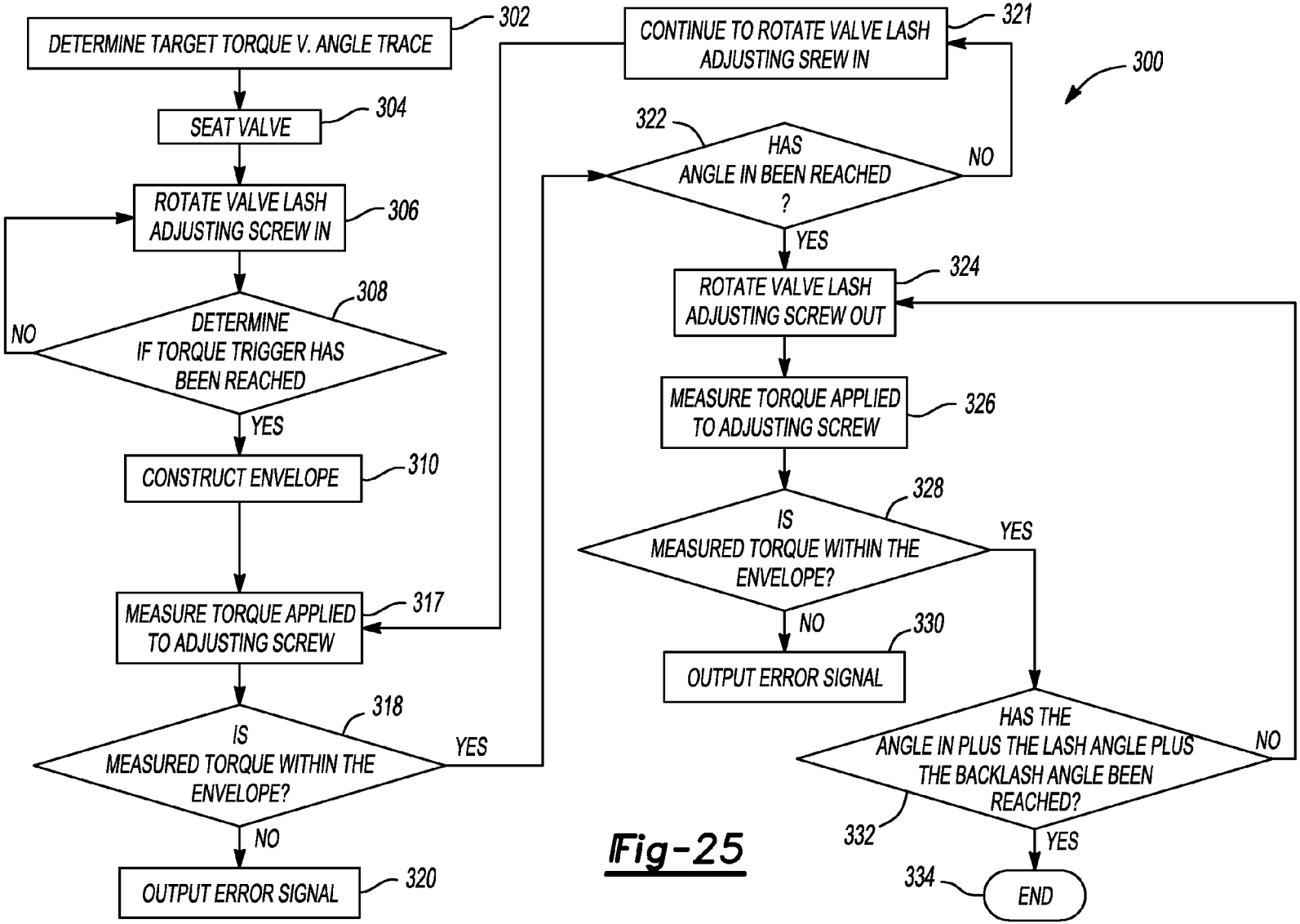
FIG. 25 is a flow chart depicting the alternate embodiment method relating to FIG. 24.

FIG. 25 is a flow chart depicting the steps performed by alternate valve lash adjustment procedure 300. Prior to beginning an actual adjustment, a target torque versus angle trace 301 is generated at step 302. The target trace 301 is constructed by repeatedly measuring a parameter associated with setting the valve lash such as valve lash adjusting screw torque during a number of known "good" lash setting trials. A "nominal" or average target trace is mathematically defined from the multiple sets of data collected. This empirical method provides a relatively easy way to account for design differences in spring preload, spring rate, valve lash adjusting screw thread pitch, geometry of the rocker arm, and frictional losses within the system. Accordingly, it may be desirable to collect data and determine a different target torque versus angle trace for each type of internal combustion engine head as well as individual target traces for intake valves and exhaust valves of the same head if the intake and exhaust valve springs are constructed according to different specifications.

Once target torque versus angle trace 301 has been constructed, individual valve lash settings may be made and verified via process 300. The apparatus used to make the valve lash adjustment may be constructed as previously described or may include any number of drive mechanisms not shown. However, it should be appreciated that the present method defined at 300 may be used with an apparatus that does not include separate probes and sensors operable to measure that actual lash set. If an additional validation step is desired, these components may still be used in conjunction with method 300.

An individual valve lash setting process begins at step 304 where the valve screw is rotated to a position where the valve is seated. The exact position of the valve lash adjustment screw relative to the valve seat position need not be known.

The valve lash adjusting screw is rotated inwardly at step 306. The inward direction is described as the direction in which the valve lash adjusting screw is rotated to move the valve off of its seat. The valve lash adjusting screw continues to be rotated in until a torque trigger 307 has been reached at step 308. The torque trigger 307 is set at a predetermined value greater than the torque expected to rotate the valve lash adjusting screw relative to the nut, when the valve is seated, including frictional losses and small burrs that may be formed on the threads. The torque trigger magnitude is set below the expected torque required to move the valve from its seat. In the example shown in FIG. 24, the torque trigger 307 is set approximately half-way between zero and the torque required to move the valve from its seat.

Once the torque trigger has been reached, an envelope or data set is constructed at step 310. The envelope is bounded by a low side trace 312 and high side trace 314 positioned on opposite sides of target torque versus angle trace 301 that was determined at step 302. The magnitude of spacing between low side trace 312 and high side trace 314 may be determined by beginning with the known tolerance that is acceptable for the set valve lash.

If the valve lash is to be set to a target clearance plus or minus a tolerance, the thread pitch of the valve lash adjusting screw may be taken into account along with the lever arm ratios set by the rocker arm to calculate the number of degrees the valve lash adjusting screw should be rotated to equate to a certain quantity of valve lash obtained by the procedure. For example, if the valve lash adjusting screw has a thread pitch of 1 mm and the rocker arm lever ratio is 1:1, each degree of valve lash adjusting screw rotation corresponds to 0.00277 mm in lash. As such, if the valve lash target has a tolerance of plus or minus 0.05 mm the total spacing between low side trace 312 and high side trace 314 along the substantially vertically aligned portion of target torque trace 301 is 18 degrees. It should be appreciated that the spacing of low side trace 312 and high side trace 314 from target trace 301 may vary based upon the position along the target torque versus angle trace. It is contemplated that the tolerance about the substantially vertically oriented portions of the target torque trace 301 are defined as previously described. However, the height of the envelope near the upper horizontally aligned portion of the trace may be empirically defined based on variance data collected during the initial valve lash adjustment of "good" parts. Accordingly, the spacing between low side trace 312 and high side trace 314 may or may not vary along the length of target trace 301.

Furthermore, the envelope surrounding the end portion of the target torque curve may also be different from the magnitude of offset from the other portions of the target curve. For example, the high side trace 314 will typically be set at a torque magnitude slightly above the estimated variance in the torque required to rotate the valve lash adjusting screw relative to the nut when the valve is seated.

At step 317, torque being applied to the valve lash adjusting screw is measured. At decision block 318, the measured torque is compared to the envelope. If the measured torque is outside of the envelope, the process proceeds to step 320 where an error signal is output. Depending on the program utilized, the valve lash adjustment sequence may be restarted or the sequence may stop waiting for an operator to remove the part for inspection and/or rebuild.

If the measured torque is within the envelope, multiple measurements and comparisons are made and the procedure continues by rotating the valve lash screw inwardly at step 321 until a predetermined "Angle In" has been reached at step 322. Once the predetermined "Angle In" has been reached, the valve lash adjusting screw is rotated in the opposite or out direction as listed in step 324.

Figure 26:
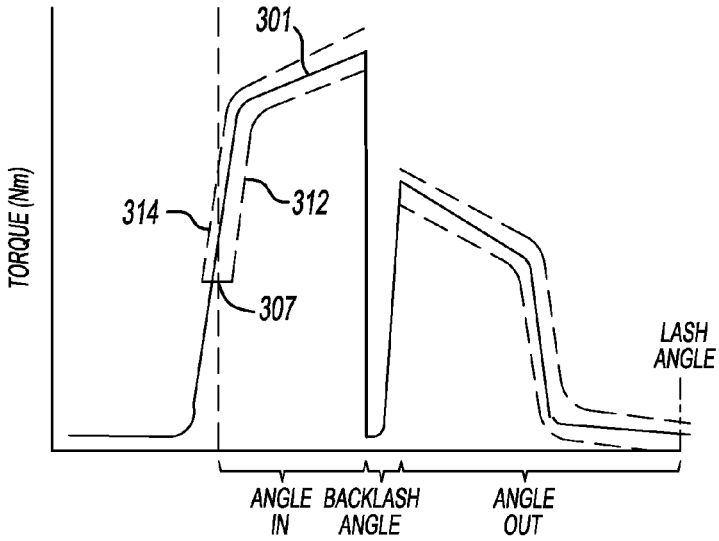
FIG. 26 is a graph depicting valve lash setting data using a machine having backlash.

In some lash adjusting machines, a backlash or clearance exists between the driving and driven components. Accordingly, when the valve lash adjusting machine attempts to rotate the valve lash adjusting screw in the opposite direction, the clearance must first be traversed. FIG. 26 shows a torque v. angle trace for valve adjustment using a machine with backlash. Once the motor driving the valve lash adjusting screw changes direction of rotation, the motor rotates through a "Backlash Angle" input prior to the valve lash adjusting screw being rotated. Torque decreases during rotation through the "Backlash Angle" and increases again once the valve lash adjusting screw begins to rotate in the opposite direction.

Torque continues to be measured at step 326 and the measured torque continues to be compared to the envelope at step 328. If the measured torque falls outside of the envelope, the process is stopped and an error signal is output at block 330. If the measured torque lies within the envelope, the valve lash adjustment screw continues to be rotated out until an "Angle Out" equals the "Angle In" plus a "Lash Angle" and "Backlash Angle" of the powertrain, if present. Decision block 332 sets up this condition. The "Lash Angle" corresponds to the number of degrees the valve lash adjusting screw must be rotated to provide the desired lash between the valve and the rocker arm. Once the "Angle Out" equals "Angle In" plus the "Lash Angle" and the "Backlash Angle" the process ends at 334.

Figure 27:
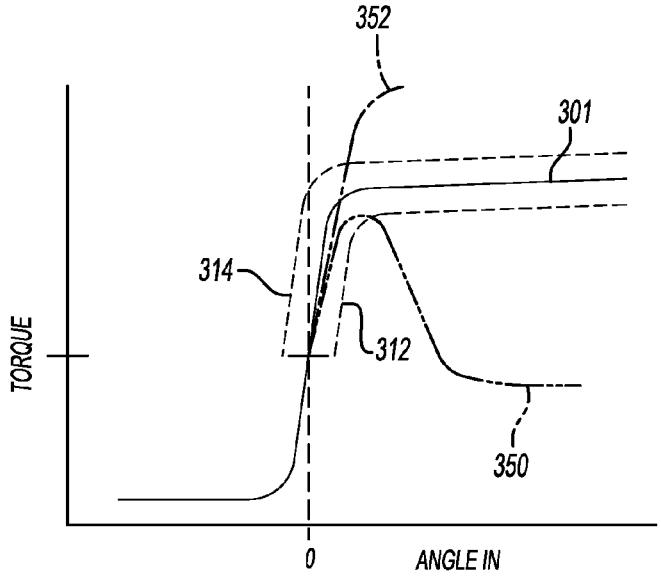
FIGS. 27 and 28 are graphs depicting valve lash setting data lying outside of an envelope.

FIG. 27 depicts an "Angle In" portion of two different theoretical valve lash setting trials. During the first valve lash setting trial, trace 350 was generated. This trace represents a burr or some other form of contamination being present between the threads of the valve lash adjustable screw and the valve lash lock nut. Because a portion of the trace 350 lies outside of the envelope defined by low side trace 312 and high side trace 314, an error would have been indicated at step 320. A trace 352 depicts theoretical data representing an attempted valve lash adjustment on a system having an improperly assembly valve train such as a head with a jammed push rod. Because a portion of trace 352 lies outside the envelope defined by traces 312 and 314, an error signal would have been output during lash valve adjustment procedure 300 and the improper build condition would have been detected.

Figure 28:
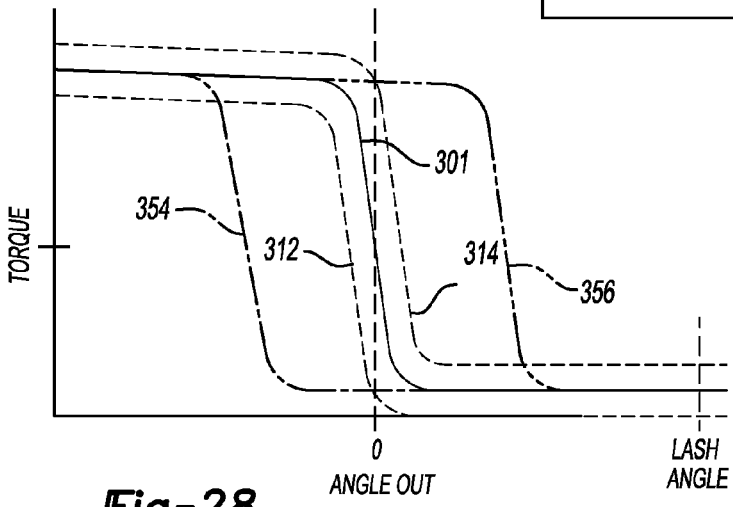

FIG. 28 depicts the "Angle Out" portion of the valve lash adjustment procedure 300. A first trace 354 depicts a theoretical valve lash adjustment trial where the lash setting would be too large. Because a portion of trace 354 lies outside the envelope defined by low side trace 312 and high side trace 314, an error signal would be output at block 330. Based on this signal, the valve lash adjustment method may be repeated or the operator may be signaled to remove the part from the adjustment apparatus. A trace 356 represents a theoretical set of data where the lash produced by the valve lash adjustment method would be too small. Once again, because a portion of the trace 356 lies outside the envelope defined by traces 312 and 314, an error signal would be output at step 330 providing an indication of the incorrect valve lash setting.

While various embodiments of the valve lash adjustment apparatus and method has been disclosed, variations may be made within the scope of the present invention. For example, the presently disclosed machine can be employed to set the valve lash or valve tappet clearance for overhead cam engines employing a screw or rotary type adjustment. Furthermore, hydraulic motors and other gear combinations can drive the socket, bit, probe and plunger of the present invention. It is alternately envisioned that other force, pressure and/or location sensors and/or measuring device may be used. For example, electrical current sensors can be employed to indirectly measure motor torque. Optical sensors can alternately be provided to measure rotational and/or linear location and relative adjustment of the rocker arm or adjusting screw.

Other motor sizes, torque ratings and types (for example, air motors) can be used. It is noteworthy that some engines use a prevailing torque configuration to secure the adjusting screw setting and, thus, do not use locking nut 61, but may still be subject to various aspects of the present invention, such as the angle/probe displacement and verification procedures. Furthermore, it should be appreciated that the definition of "valve lash lock nut" as used in the claims, includes any internally patterned member that can engage with the valve lash adjusting screw or stud, and equivalents thereto and need not contain a locking structure. Similarly, it should be appreciated that the definition of "valve lash adjusting screw" as used in the claims, includes any adjustable member that varies valve lash when moved, whether it be an elongated and externally patterned stud, a threaded shaft, movable rod or equivalents thereto. While various materials and forces have been disclosed, it should be appreciated that a variety of other materials and forces can be employed. It is intended by the following claims to cover these and any other departures from the disclosed embodiments which fall within the true spirit of this invention.

What is claimed is:

1. A method of setting valve lash for an internal combustion engine, the method comprising:

rotating a valve lash adjusting screw in a first direction to move a valve off of its seat;

determining an inflection point in the adjusting screw torque as the adjusting screw continues to rotate in the first direction;

rotating the valve lash adjusting screw in the first direction a predetermined angle past the inflection point; and rotating the valve lash adjusting screw in a second direction opposite the first direction an amount equal to the first predetermined angle plus a second predetermined angle to set the valve lash.

2. The method of claim 1 further including verifying the valve lash adjustment by determining an actual valve lash and comparing the actual valve lash to a target valve lash.

3. The method of claim 1 further including directly contacting the valve with a probe to determine the actual valve lash.

4. The method of claim 3 further including performing the steps to set the valve lash a second time if the actual valve lash is not within a predetermined range of the target valve lash.

5. The method of claim 4 further including providing an error indication if the actual valve lash is not acceptable after the valve lash setting steps have been performed a predetermined number of times.

6. The method of claim 1 further including defining the second predetermined angle as a function of the valve lash adjusting screw thread pitch plus a backlash angle if present.

7. A method of setting valve lash for an internal combustion engine, the method comprising:

rotating a valve lash adjusting screw in a first direction to move a valve off of its seat;

determining an inflection point in the valve displacement as the adjusting screw continues to rotate in a first direction;

rotating the valve lash adjusting screw in the first direction a predetermined amount past the inflection point; and rotating the valve lash adjusting screw in a second direction opposite the first direction the predetermined amount and an additional angle to set the valve lash.

8. The method of claim 7 further including verifying the valve lash adjustment by determining an actual valve lash and comparing the actual valve lash to a target valve lash.

9. The method of claim 8 further including directly contacting the valve with a probe to determine the actual valve lash.

10. The method of claim 9 further including performing the steps to set the valve lash a second time if the actual valve lash is not within a predetermined range of the target valve lash.

11. The method of claim 7 further including rotating the valve lash adjusting screw in the second direction an additional backlash angle.

12. A method of setting valve lash for an internal combustion engine, the method comprising:

rotating a valve lash adjusting screw in a first direction to move a valve off of its seat;

rotating the valve lash adjusting screw in a second direction opposite the first direction;

determining an inflection point in a measured parameter as the adjusting screw continues to rotate in the second direction; and rotating the valve lash adjusting screw in the second direction an additional angle past the inflection point to set the valve lash.

13. The method of claim 12 wherein the measured parameter valve is lash adjusting screw torque.

14. The method of claim 12 wherein the measured parameter is valve displacement.

15. The method of claim 12 further including verifying the valve lash adjustment by determining an actual valve lash and comparing the actual valve lash to a target valve lash.

* * * * *